US010168084B2

(12) United States Patent
Ota et al.

(10) Patent No.: US 10,168,084 B2
(45) Date of Patent: Jan. 1, 2019

(54) REFRIGERANT EVAPORATOR

(71) Applicant: DENSO CORPORATION, Kariya, Aichi-pref. (JP)

(72) Inventors: Aun Ota, Kariya (JP); Naohisa Ishizaka, Kariya (JP); Norimasa Baba, Kariya (JP); Shota Chatani, Kariya (JP); Masakazu Nagaya, Kariya (JP); Eiichi Torigoe, Kariya (JP); Kengo Kazari, Kariya (JP); Daisuke Haseba, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 319 days.

(21) Appl. No.: 14/889,505

(22) PCT Filed: May 9, 2014

(86) PCT No.: PCT/JP2014/002459
§ 371 (c)(1),
(2) Date: Nov. 6, 2015

(87) PCT Pub. No.: WO2014/181550
PCT Pub. Date: Nov. 13, 2014

(65) Prior Publication Data

US 2016/0084548 A1 Mar. 24, 2016

(30) Foreign Application Priority Data

May 10, 2013 (JP) ..... 2013-100488
Jul. 18, 2013 (JP) ..... 2013-149757

(51) Int. Cl.
*F25B 39/02* (2006.01)
*F28F 9/02* (2006.01)
(Continued)

(52) U.S. Cl.
CPC ..... *F25B 39/028* (2013.01); *F28D 1/05325* (2013.01); *F28D 1/05333* (2013.01);
(Continued)

(58) Field of Classification Search
CPC ..... F25B 39/028; F25B 39/02; F28F 9/0265; F28F 9/0268; F28F 9/02; F28F 9/262;
(Continued)

(56) References Cited

U.S. PATENT DOCUMENTS 4,524,823 A 6/1985 Hummel et al.
4,593,539 A 6/1986 Humpolik et al.
(Continued)

FOREIGN PATENT DOCUMENTS

GB 2450244 A 12/2008
JP H04295599 A 10/1992
(Continued)

OTHER PUBLICATIONS

International Search Report and Written Opinion (in Japanese with English Translation) for PCT/JP2014/002459, dated Aug. 5, 2014; ISA/JP.

*Primary Examiner* — Joseph Trpisovsky
(74) *Attorney, Agent, or Firm* — Harness, Dickey & Pierce, P.L.C.

(57) ABSTRACT

A refrigerant evaporator has an interchange part. The interchange part connects a first collecting part of a second downstream tank part, and a second distribution part of a second upstream tank part. The interchange part connects a second collecting part of a second downstream tank part, and a first distribution part of a second upstream tank part. The interchange part swaps a refrigerant about a width direction of a core. Refrigerant passages relevant to the interchange
(Continued)

part are configured to improve refrigerant distribution. Providing a plurality of passages and/or twisting a passage improve distribution.

8 Claims, 17 Drawing Sheets

(51) Int. Cl.
*F28D 1/053* (2006.01)
*F28D 21/00* (2006.01)

(52) U.S. Cl.
CPC ..... *F28D 1/05391* (2013.01); *F28F 9/0265* (2013.01); *F28F 9/0268* (2013.01); *F28D 2021/0071* (2013.01)

(58) Field of Classification Search
CPC ..... F28F 9/0243; F28D 1/05391; F28D 1/05325; F28D 1/05333; F28D 2021/0071
USPC ..... 62/525
See application file for complete search history.

(56) References Cited

U.S. PATENT DOCUMENTS

| | | | |
|---|---|---|---|
| 6,321,562 | B1 | 11/2001 | Narahara et al. |
| 2004/0206490 | A1 | 10/2004 | Katoh et al. |
| 2007/0074861 | A1 | 4/2007 | Higashiyama |
| 2010/0206535 | A1 | 8/2010 | Munoz et al. |
| 2015/0027163 | A1 | 1/2015 | Ishizaka et al. |

FOREIGN PATENT DOCUMENTS

| | | | |
|---|---|---|---|
| JP | H06257892 | A | 9/1994 |
| JP | 2001074390 | A | 3/2001 |
| JP | 2001-221535 | A | 8/2001 |
| JP | 2002139292 | A | 5/2002 |
| JP | 2006029697 | A | 2/2006 |
| JP | 2006336890 | A | 12/2006 |
| JP | 4024095 | B2 | 12/2007 |
| JP | 4124136 | B2 | 7/2008 |
| JP | 4625687 | B2 | 2/2011 |
| JP | 2013096653 | A | 5/2013 |
| JP | 2013185723 | A | 9/2013 |
| KR | 1020060074724 | A | 7/2006 |
| WO | WO-2014181546 | A1 | 11/2014 |
| WO | WO-2014181547 | A1 | 11/2014 |

REFRIGERANT EVAPORATOR

CROSS REFERENCE TO RELATED APPLICATIONS

This application is a U.S. National Phase Application under 35 U.S.C. 371 of International Application No. PCT/JP2014/002459 filed on May 9, 2014 and published in Japanese as WO 2014/181550 A1 on Nov. 13, 2014. This application is based on and claims the benefit of priority from Japanese Patent Applications No. 2013-100488 filed on May 10, 2013, and No. 2013-149757 filed on Jul. 18, 2013. The entire disclosures of all of the above applications are incorporated herein by reference.

TECHNICAL FIELD

The present disclosure relates to a refrigerant evaporator for cooling fluid to be cooled by evaporating refrigerant by absorbing heat from the fluid to be cooled.

BACKGROUND ART

Patent Literatures 1 and 2 indicate refrigerant evaporators. The refrigerant evaporator evaporates a refrigerant flowing inside by absorbing heat from fluid to be cooled flowing outside, e.g., air. As a result, the refrigerant evaporator functions as a heat exchanger for cooling which cools the fluid to be cooled. Disclosed refrigerant evaporators have a first evaporative portion and a second evaporating portion which are arranged on an upstream side and a downstream side with respect to a flowing direction of the fluid in a series manner. Each evaporating portion has a core part configured by stacking a plurality of tubes, and a pair of tank parts connected to the both ends of the plurality of tubes. The core part of the first evaporating portion is partitioned in a width direction, i.e., in a right-and-left direction. In addition, the core part of the second evaporating portion is also partitioned in the width direction, i.e., the right-and-left direction.

The refrigerant evaporators disclosed in Patent Literatures 1 and 2 has an interchange part which is disposed in a communicating portion for flowing the refrigerant from the downstream first evaporating portion to the upstream second evaporating portion and interchanges the refrigerant in the right-and-left direction. The interchange part is provided by two communicating portions. One communicating portion leads the refrigerant flowing out from one side part, e.g., a right side part, of the first evaporating portion to the other side part, e.g., a left side part, of the second evaporating portion. In addition, the other one communicating portion leads the refrigerant flowing out from the other side part, e.g., a left side part, of the first evaporating portion, to the one side part, e.g., a right side part, of the second evaporating portion. The interchange part may also be called as a cross-flow passage. This structure is effective to suppress unevenness of a temperature distribution in the refrigerant evaporator. This structure is also effective to suppress the unevenness of a temperature distribution of external fluid.

In the refrigerant evaporator disclosed in Patent Literature 1, it is configured to interchange the refrigerant flow in a width direction, i.e., in the right-and-left direction, of the core part, when the refrigerant passed through the core part of the first evaporating portion to the core part of the second evaporating portion through one side tank part of the evaporating portions and a pair of communicating portions which connect the tank parts. That is, the refrigerant evaporator is configured to make the refrigerant flowing in one side of the core part of the first evaporating portion in the width direction flows into the other side of the core part of the second evaporating portion in the width direction by using one communicating portion, and to make the refrigerant flowing in the other side of the core part of the first evaporating portion in the width direction flows into the one side of the core part of the second evaporating portion in the width direction by using one communicating portion among a pair of communicating portions.

CITATION LIST

Patent Literatures

Patent Literature 1: JP4124136B
Patent Literature 2: JP2013-96653A

SUMMARY OF INVENTION

Here, the refrigerant evaporator disclosed in Patent Literature 1 has only one of the communicating portion which makes the refrigerant flowing in one side of the core part of the first evaporating portion in the width direction flows into the other side of the core part of the second evaporating portion in the width direction, and only one of the communicating portion which makes the refrigerant flowing in the other side of the core part of the first evaporating portion in the width direction flows into one side of the core part of the second evaporating portion in the width direction, respectively.

Accordingly, the pressure loss of the refrigerant increases in proportion to a length of a distance between the refrigerant inlet, which is a connecting portion to the communicating portion in the tank part, and the end of the tube. A refrigerant amount flowing into the tube decreases. As a result, in this core part, a liquid phase refrigerant is unevenly distributed, and unevenness on the temperature distribution may arise in the flowing air which passes the refrigerant evaporator.

In the structure of the conventional technique, unevenness on distribution of a gas component and a liquid component of the refrigerant may be created in the interchange part. For example, the gas component and the liquid component of the refrigerant may be separated in the interchange part. Such unevenness of the refrigerant component distribution in the interchange part may create unevenness of the refrigerant distribution which is not desirable in the core part in the downstream of refrigerant flow, i.e., the core part of the second evaporating portion. Such unevenness of the refrigerant distribution may give the temperature distribution which is not desirable to external fluid. In the above viewpoint, or in the other viewpoint not mentioned above, further improvement of the refrigerant evaporator is still demanded.

It is one of objects of the invention to provide an improved refrigerant evaporator.

The invention is created based on the above point, and has an object to provide a refrigerant evaporator which can suppress lowering of a distribution of the refrigerant.

It is another object of the invention to provide a refrigerant evaporator which can suppress separation of the refrigerant components in an interchange part.

The present invention employs the following technical means, in order to attain the above-mentioned object. The symbols in the parenthesis indicated in the above section and the claim merely show correspondence relations with concrete elements described in embodiments later mentioned as one example, and are not intended to limit the technical scope of this disclosure.

One of an invention disclosed here provides a refrigerant evaporator. The refrigerant evaporator performs heat exchange between a fluid to be cooled flowing outside and a refrigerant. The refrigerant evaporator has a first evaporating portion and a second evaporating portion arranged in series to a flow direction of the fluid to be cooled. The first evaporating portion and the second evaporating portion respectively include: a core part for heat exchange formed by stacking a plurality of tubes in which a refrigerant flows; and a pair of tank parts which are connected with both ends of the plurality of tubes, and perform collecting and distribution of the refrigerant flowing through the plurality of tubes. The core part in the first evaporating portion has a first core part configured by a group of some tubes among the plurality of tubes, and a second core part configured by a group of remaining tubes. The core part in the second evaporating portion has a third core part configured by a group of tubes opposing at least a part of the first core part in a flow direction of the fluid to be cooled among the plurality of tubes, and a fourth core part configured by a group of tubes opposing at least a part of the second core part in a flow direction of the fluid to be cooled. One tank part among a pair of tank parts in the first evaporating portion is configured to include a first collecting part which collects the refrigerant from the first core part, and a second collecting part which collects the refrigerant from the second core part. One tank part among a pair of tank parts in the second evaporating portion is configured to include a first distribution part which distributes the refrigerant to the third core part, and a second distribution part which distributes the refrigerant to the fourth core part. The first evaporating portion and the second evaporating portion are connected through a refrigerant inter change part having a first communicating portion which leads the refrigerant in the first collecting part to the second distribution part and a second communicating portion which leads the refrigerant in the second collecting part to the first distribution part. The first distribution part is connected with the second communicating portion and is disposed with a refrigerant inlet which makes the refrigerant from the second collecting part flows into the first distribution part. The second collecting part is connected with the second communicating portion and is disposed with a refrigerant outlet which makes the refrigerant in the second collecting part flows out to the first distribution part. The refrigerant outlet and the refrigerant inlet are different in numbers.

According to this, the refrigerant outlet which makes the refrigerant in the second collecting part flows out to the first distribution part, and the refrigerant inlet which make the refrigerant from the second collecting part flows into the first distribution part are different in numbers thereof. Therefore, the refrigerant passage through which flows out from the second collecting part and flows into the first distribution part 13*a* branches therein. Accordingly, since the pressure loss of the refrigerant flowing in the refrigerant passage can be reduced, it becomes possible to suppress that a liquid phase refrigerant is distributed in the third core part in a leaning manner. Therefore, it becomes possible to suppress lowering of the cooling capability of the fluid in the refrigerant evaporator.

One of an invention disclosed here provides a refrigerant evaporator. The refrigerant evaporator performs heat exchange between a fluid to be cooled flowing outside and a refrigerant. The refrigerant evaporator comprises a first evaporating portion and a second evaporating portion arranged in series to a flow direction of the fluid to be cooled. The first evaporating portion and the second evaporating portion respectively include: a core part for heat exchange formed by stacking a plurality of tubes in which a refrigerant flows; and a pair of tank parts which are connected with both ends of the plurality of tubes, and perform collecting and distribution of the refrigerant flowing through the plurality of tubes. The core part in the first evaporating portion has a first core part configured by a group of some tubes among the plurality of tubes, and a second core part configured by a group of remaining tubes. The core part in the second evaporating portion has a third core part configured by a group of tubes opposing at least a part of the first core part in a flow direction of the fluid to be cooled among the plurality of tubes, and a fourth core part configured by a group of tubes opposing at least a part of the second core part in a flow direction of the fluid to be cooled. One tank part among a pair of tank parts in the first evaporating portion is configured to include a first collecting part which collects the refrigerant from the first core part, and a second collecting part which collects the refrigerant from the second core part. One tank part among a pair of tank parts in the second evaporating portion is configured to include a first distribution part which distributes the refrigerant to the third core part, and a second distribution part which distributes the refrigerant to the fourth core part. The first evaporating portion and the second evaporating portion are connected through a refrigerant inter change part having a first communicating portion which leads the refrigerant in the first collecting part to the second distribution part and a second communicating portion which leads the refrigerant in the second collecting part to the first distribution part. The first distribution part is connected with the second communicating portion and is disposed with a plurality of refrigerant inlet which makes the refrigerant from the second collecting part flows into the first distribution part.

According to this, two or more refrigerant inlet which makes the refrigerant from the second core part flows into the first distribution part is disposed in the first distribution part. As a result, as compared with a case where one first refrigerant inlet is disposed, it is possible to shorten a distance between an end of the tube most distanced from the first refrigerant inlet and the first refrigerant inlet.

An amount of the refrigerant flowing into the tube is increased, as the distance of the first refrigerant inlet and the end of the tube becomes short. Accordingly, as compared with a case where one refrigerant inlet is disposed, a refrigerant amount flowing into the tube is increased by shortening a distance between an end of the tube most distanced from the first refrigerant inlet and the first refrigerant inlet. Accordingly, since it is possible to suppress a leaning of the refrigerant amount flowing into each tube, it becomes possible to suppress that a liquid phase refrigerant is distributed in the third core part in a leaning manner. Therefore, it becomes possible to suppress lowering of the cooling capability of the fluid in the refrigerant evaporator.

One of an invention disclosed here provides a refrigerant evaporator. An invention is characterized by comprising: a plurality of upstream core parts arranged at an upstream side of the fluid to be cooled; a plurality of downstream core parts arranged at an downstream side of the fluid to be cooled; and a shifting communication part which communicates the upstream core part and the downstream core part which are positioned in positions not overlap at least partially with respect to a flow direction of the fluid to be cooled, and makes the refrigerant flows them in an order, wherein the shifting communication part has a twisting part for making the refrigerant flows while swirling.

According to this structure, refrigerant flows while swirling by the twisting portion. Accordingly, it is possible to reduce separation of refrigerant components at the shifting communication part disposed between the upstream core part and the downstream core part.

DETAILED DESCRIPTION

Embodiments of the present disclosure are explained referring to drawings. In the embodiments, the same parts and components as those in each embodiment are indicated with the same reference numbers and the same descriptions will not be reiterated. In a case that only a part of component is described, the other embodiments previously described may be applied to the other parts of components. In a consecutive embodiment, a correspondence is shown by using a similar reference symbol in which only hundred and more digits differ to indicate a part corresponding to a matter described in the previous embodiment, and the same description may not be repeated.

First Embodiment

The first embodiment is described with reference to FIGS. 1-6. A refrigerant evaporator 1 according to this embodiment is applied to a vapor compressing type refrigeration cycle for a vehicle air-conditioner which adjusts a temperature of a vehicle compartment. The refrigerant evaporator 1 is a cooling heat exchanger which cools a flowing air by evaporating a refrigerant (liquid phase refrigerant) by absorbing heat from the flowing air blown to the vehicle compartment. The flowing air is a fluid to be cooled and flowing outside of the refrigerant evaporator.

As known in this field, the refrigeration cycle has a compressor, a radiator (condenser), an expansion valve, etc. which are not illustrated. In this embodiment, the refrigeration cycle is configured as a receiver cycle which arranges the receiver between the condenser and the expansion valve. In addition, a refrigeration-machine-oil for lubricating the compressor is mixed in the refrigerant for the refrigeration cycle. A part of the refrigeration machine oil circulates the cycle with the refrigerant.

Figure 1:
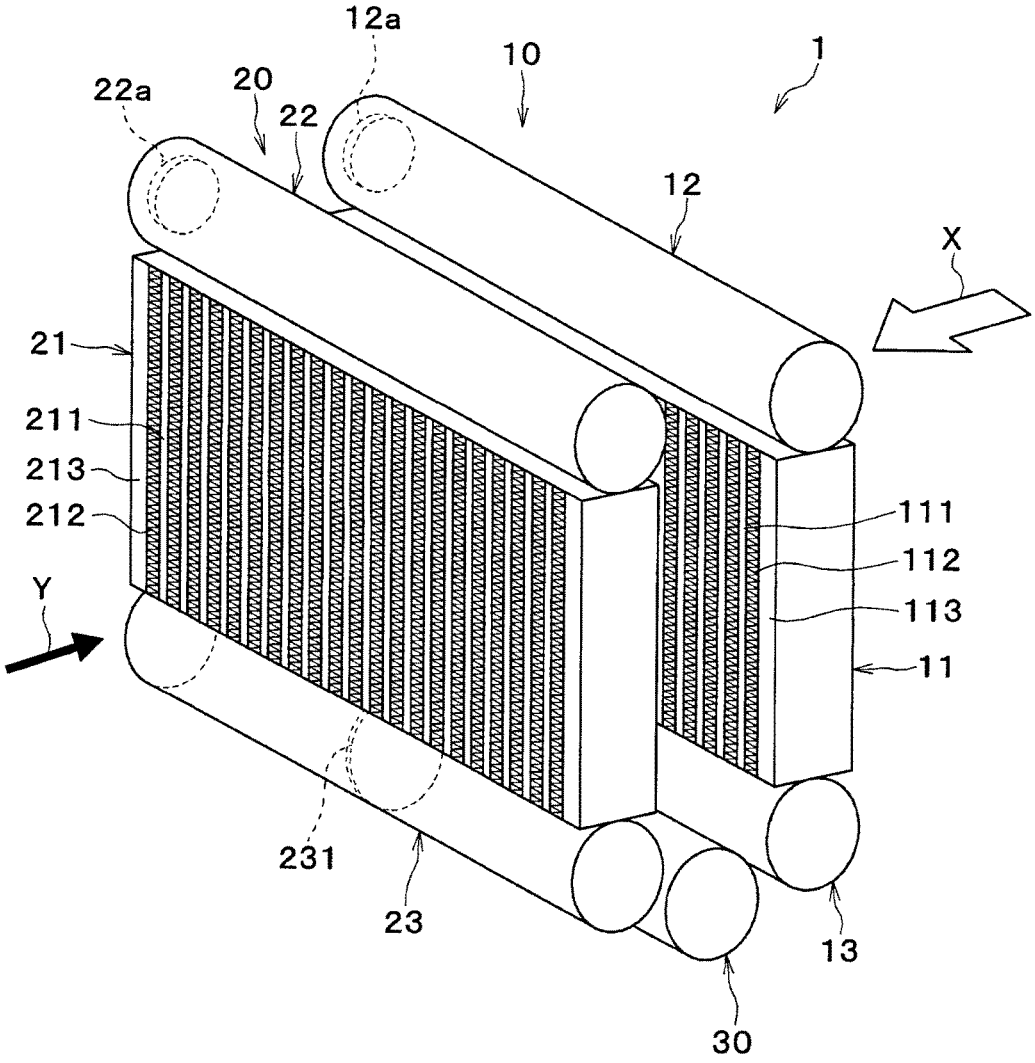
FIG. 1 is a schematic perspective view of a refrigerant evaporator according to a first embodiment.
Figure 2:
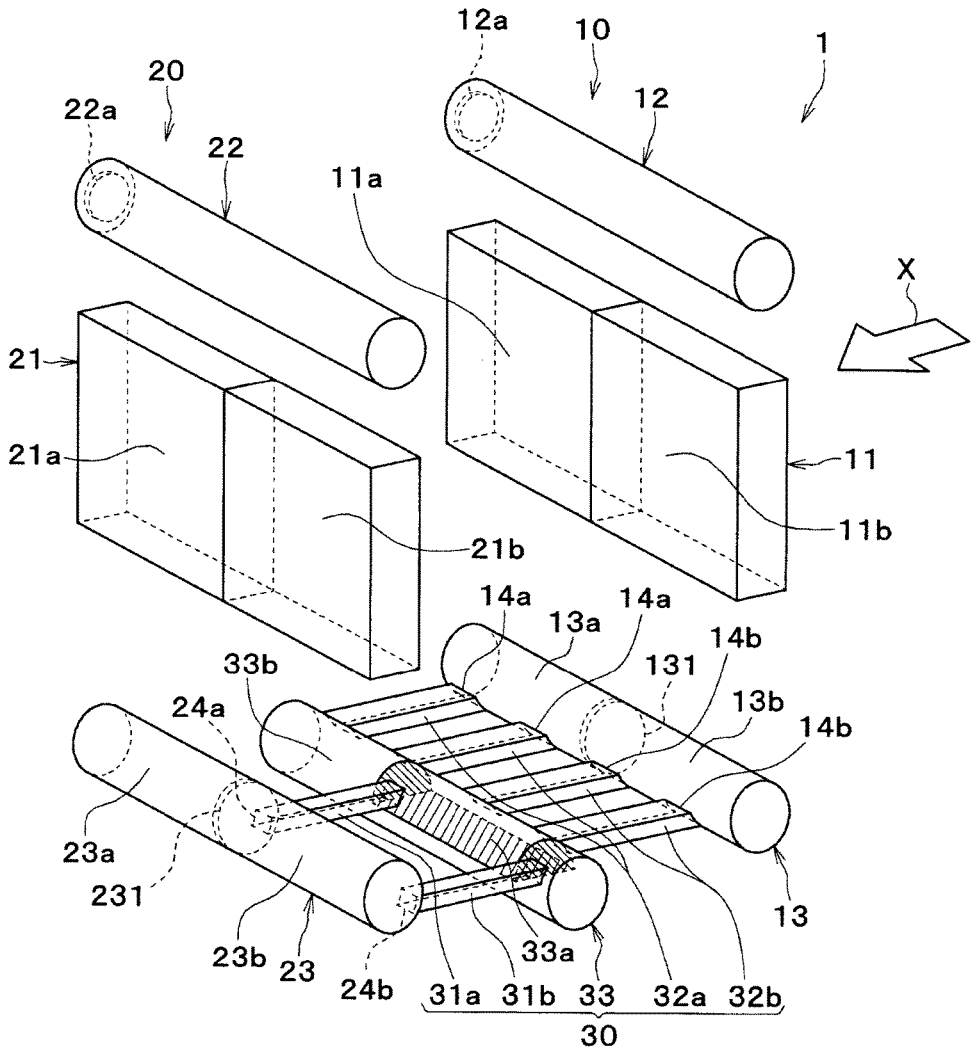
FIG. 2 is an exploded perspective view of the refrigerant evaporator shown in FIG. 1.

In FIG. 2, the tubes 111 and 211 in the core parts 11 and 21 and fins 112 and 212 for a heat exchange mentioned later are not illustrated.

As shown in the drawing, the refrigerant evaporator 1 has two evaporating portions 10 and 20. Two evaporating portions 10 and 20 are arranged in series at an upstream side and a downstream side with respect to a flow direction of air, i.e., a flow direction X of the fluid to be cooled. An air upstream evaporating portion 10 arranged at the upstream side of the air flow direction X is also called as an upper evaporating portion 10 or a windward side evaporating portion 10. The upstream evaporating portion 10 is also called as a second evaporating portion 10. Hereafter, the upstream evaporating portion 10 is called as the AU evaporating portion 10. The air downstream evaporating portion 20 arranged at the downstream side of the air flowing direction X is also called as a downstream evaporating portion 20 or a leeward side evaporating portion 20. The downstream evaporating portion 20 is also called as a first evaporating portion 20. Hereafter, the downstream evaporating portion 20 is called as an AD evaporating portion 20.

The fundamental structure of the AU evaporating portion 10 and the AD evaporating portion 20 is the same. The AU evaporating portion 10 has a core part 11 for heat exchange and a pair of tank parts 12 and 13 arranged at an up-and-down both sides of the core part 11. The AD evaporating portion 20 has a core part 21 for heat exchange, and a pair of tank parts 22 and 23 arranged at an up-and-down both sides of the core part 21.

The core part for heat exchange in the AU evaporating portion 10 is called an AU core part 11. The core part for heat exchange in the AD evaporating portion 20 is called an AD core part 21. Among a pair of tank parts 12 and 13 in the AU evaporating portion 10, the tank part arranged on the up side is called a first AU tank part 12 and the tank part arranged on the lower side is called a second AU tank part 13. Similarly, among a pair of tank parts 22 and 23 in the AD evaporating portion 20, the tank part arranged on the up side is called a first AD tank part 22 and the tank part arranged on the lower side is called a second AD tank part 23.

Each one of the AU core part 11 and the AD core part 21 of this embodiment is configured by a stacked member in which a plurality of tubes 111 and 211 extended in an up-and-down direction and the fins 112 and 212 joined between adjacent tubes 111 and 211 are stacked alternately. A stacking direction in the stacked member of the plurality of tubes 111 and 211 and the plurality of fins 112 and 212 is hereafter called as a tube stacking direction.

Here, the AU core part 11 has the first AU core part, i.e., a first upstream core part, 11*a* which is configured by a group of some tubes among the plurality of tubes 111, and the second AU core part, i.e., a second upstream core part, 11*b* which is configured by a group of remaining tubes. The first AU core part 11*a* provides a third core part. The second AU core part 11*b* provides a fourth core part.

When viewing the AU core part 11 from the flow direction of flowing air, the first AU core part 11*a* is configured by a group of tubes existing on the right side in the tube stacking direction, and the second AU core part 11*b* is configured by a group of tubes existing on the left side in the tube stacking direction.

The AD core part 21 has the first AD core part, i.e., a first downstream core part, 21*a* which is configured by a group of some tubes among the plurality of tubes 211, and the second AD core part, i.e., a second downstream core part, 21*b* which is configured by a group of remaining tubes. The first AD core part 21*a* provides a first core part. The second AD core part 21*b* provides a second core part.

When viewing the AD core part 21 from the flow direction of flowing air, the first AD core part 21*a* is configured by a group of tubes existing on the right side in the tube stacking direction, and the second AD core part 21*b* is configured by a group of tubes existing on the left side in the tube stacking direction. When viewing from the flow direction of flowing air, the first AU core part 11*a* and first AD core part 21*a* are arranged to overlap each other, i.e., to oppose, and the second AU core part 11*b* and the second AD core part 21*b* are arranged to overlap each other, i.e., to oppose.

Each tube 111 and 211 are formed with a refrigerant passage in which the refrigerant flows, and are configured by a flat tube which has a cross sectional shape formed in a flat shape extending along the flow direction of flowing air.

The tubes 111 of the AU core part 11 is connected with the first AU tank part 12 at one end side (upper end side) in the longitudinal direction, and is also connected with the second AU tank part 13 at the other end side (lower end side) in the longitudinal direction. The tubes 211 of the AD core part 21 is connected with the first AD tank part 22 at one end side (upper end side) in the longitudinal direction, and is also connected with the second AD tank part 23 at the other end side (lower end side) in the longitudinal direction.

Each fin 112 and 212 are corrugate fins which are formed by bending a thin plate material into a wave form, and is joined to a flat outer surface on the tubes 111 and 211, and provides a heat exchange facilitating member for increasing a heat transfer area between the flowing air and the refrigerant.

Side plates 113 and 213 which reinforce each core parts 11 and 12 are disposed on both ends of the tube stacking direction on the stacking member of the tubes 111 and 211 and the fins 112 and 212. Side plates 113 and 213 are joined to the fins 112 and 212 arranged on the most outside in the tube stacking direction.

The first AU tank part 12 is configured by a cylindrical member which has one end side, i.e., the left side end when viewing from the flowing direction of air, being closed, and the other end, i.e., the right side end when viewing from the flowing direction of air, being formed with the refrigerant outlet part 12*a* for leading the refrigerant out to the intake side of the compressor from the tank inside. Through holes, not shown, in which one end side, i.e., the upper end, of the tubes 111 are inserted, are formed on a bottom part of the first AU tank part 12. That is, the first AU tank part 12 is configured so that an interior space thereof communicates with the tubes 111 of the AU core part 11 respectively, and functions as a collecting part which gathers the refrigerant from the core parts 11*a* and 11*b* of the AU core part 11.

The first AD tank part 22 is configured by a cylindrical member which has one end closed and the other end which is formed with a refrigerant inlet 22*a* for introducing the low pressure refrigerant decompressed by the expansion valve, not shown, into the tank inside. Through holes, not shown, in which one end side, i.e., the upper end, of the tubes 211 are inserted, are formed on a bottom part of the first AD tank part 22. That is, the first AD tank part 22 is configured so that an interior space thereof communicates with the tubes 211 of the AD core part 21 respectively, and functions as a distribution part which distributes the refrigerant to the core parts 21*a* and 21*b* of the AD core part 21.

The second AU tank part 13 is configured by a cylindrical member with closed both ends. Through holes, not shown, in which the other end side, i.e., the lower end, of the tubes 111 are inserted, are formed on a top part of the second AU tank part 13. That is, the second AU tank part 13 is configured so that the interior space thereof communicates with each tube 111.

A partition member 131 is arranged in a center position in the longitudinal direction in an inside of the second AU tank part 13. The tank inside space is partitioned into a space to which the tubes 111 forming the first AU core part 11*a* are communicated, and a space to which the tubes 111 forming the second AU core part 11*b* are communicated.

Here, among the inside of the second AU tank part 13, a space communicated with the tubes 111 forming the first AU core part 11*a* forms a first distribution part 13*a* which distributes the refrigerant to the first AU core part 11*a*, and a space communicated with the tubes 111 forming the second AU core part 11*b* forms a second distribution part 13*b* which distributes the refrigerant to the second AU core part 11*b*.

The second AD tank part 23 is configured by a cylindrical member with closed both ends. Through holes, not shown, in which the other end side, i.e., the lower end, of the tubes 211 are inserted, are formed on a top part of the second AD tank part 23. That is, the second AD tank part 23 is configured so that the interior space thereof communicates with each tube 211.

A partition member 231 is arranged in a center position in the longitudinal direction in an inside of the second AD tank part 23. The tank inside space is partitioned into a space to which the tubes 211 forming the first AD core part 21*a* are communicated, and a space to which the tubes 211 forming the second AD core part 21*b* are communicated.

Here, among the inside of the second AD tank part 23, a space communicated with the tubes 211 forming the first AD core part 21*a* forms a first collecting part 23*a* which collects the refrigerant from the first AD core part 21*a*, and a space communicated with the tubes 211 forming the second AD core part 21*b* forms a second collecting part 23*b* which collects the refrigerant from the second AD core part 21*b*.

The second AU tank part 13 and the second AD tank part 23 are connected through a refrigerant interchange part 30 each other. The refrigerant interchange part 30 is configured to lead the refrigerant in the first collecting part 23*a* in the second AD tank part 23 to the second distribution part 13*b* in the second AU tank part 13, and to lead the refrigerant in the second collecting part 23*b* in the second AD tank part 23 to the first distribution part 13*a* in the second AU tank part 13. That is, the refrigerant interchange part 30 is configured to interchange the refrigerant flows in a core width direction in the core parts 11 and 21.

The refrigerant interchange part 30 is configured to have a pair of collecting part connecting members 31*a* and 31*b* which is connected with the first and second collecting parts 23*a* and 23*b* in the second AD tank part 23, two pairs of distribution part connecting members 32*a* and 32*b* connected with each distribution parts 13*a* and 13*b* in the second AU tank part 13, and a middle tank part 33 connected with the pair of collecting part connecting members 31*a* and 31*b* and the two pairs of distribution part connecting members 32*a* and 32*b*, respectively.

Each of the pair of collecting part connecting members 31*a* and 31*b* is made of a cylindrical member in which a refrigerant flow passage where the refrigerant flows is formed, one end side thereof is connected with the second AD tank part 23, and the other end side thereof is connected with the middle tank part 33.

The first collecting part connecting member 31*a* providing one of the pair of collecting part connecting members 31*a* and 31*b* is connected to the second AD tank part 23 to communicate with the first collecting part 23*a* at one end side, and is connected to the middle tank part 33 to communicate with a first refrigerant flow passage 33*a*, which will be mentioned later, in the middle tank part 33 at the other end side.

The second collecting part connecting member 31*b* providing the other one is connected to the second AD tank part 23 to communicate with the second collecting part 23*b* at one end side, and is connected to the middle tank part 33 to communicate with a second refrigerant flow passage 33*b*, which will be mentioned later, in the middle tank part 33 at the other end side.

In this embodiment, the one end side of the first collecting part connecting member 31*a* is connected to a position near the partition member 231 among the first collecting parts 23*a*, and the one end side of the second collecting part connecting member 31*b* is connected to a position near the closed end of the second AD tank part 23 among the second collecting parts 23*b*.

Each of two pairs of distribution part connecting members 32*a* and 32*b* is made of a cylindrical member in which a refrigerant flow passage where the refrigerant flows is formed, one end side thereof is connected with the second AU tank part 13, and the other end side thereof is connected with the middle tank part 33.

Each of two first distribution part connecting members 32*a* providing one of two pairs of distribution part connecting members 32*a* and 32*b* is connected to the second AU tank part 13 to communicate with the first distribution part 13*a* at one end side, and is connected to the middle tank part 33 to communicate with a second refrigerant flow passage 33*b*, which will be mentioned later, in the middle tank part 33 at the other end side. That is, each of two first distribution part connecting members 32*a* is communicated with the above-mentioned second collecting part connecting member 31*b* through the second refrigerant flow passage 33*b* of the middle tank part 33.

Each of the second distribution part connecting member 32*b* providing the other one is connected to the second AU tank part 13 to communicate with the second distribution part 13*b* at one end side, and is connected to the middle tank part 33 to communicate with a first refrigerant flow passage 33*a*, which will be mentioned later, in the middle tank part 33 at the other end side. That is, each of two second distribution part connecting members 32*b* is communicated with the above-mentioned first collecting part connecting member 31*a* through the first refrigerant flow passage 33*a* of the middle tank part 33.

One end side of one first distribution part connecting member 32*a* among two first distribution part connecting members 32*a* is connected to an end of the first distribution part 13*a* on a near side to the refrigerant outlet part 12*a* in the tube stacking direction. In addition, the one end side of the other one of the first distribution part connecting member 32*a* is connected to an end of the first distribution part 13*a* on a far side from the refrigerant outlet part 12*a* in the tube stacking direction.

One end side of one second distribution part connecting member 32*b* among two second distribution part connecting members 32*b* is connected to an end of the second distribution part 13*b* on a near side to the refrigerant outlet part 12*a* in the tube stacking direction. In addition, the one end side of the other one of the second distribution part connecting member 32*b* is connected to an end of the second distribution part 13*b* on a far side from the refrigerant outlet part 12*a* in the tube stacking direction.

The second AD tank part 23 is connected with the first collecting part connecting member 31*a*, and is connected with the first refrigerant outlet 24*a* which makes the refrigerant from the first collecting part 23*a* flows out to the first collecting part connecting member 31*a*, and is connected with the second collecting part connecting member 31*b*, and is formed with the second refrigerant outlet 24*b* which makes the refrigerant flows out from the second collecting part 23*b* to the second collecting part connecting member 31*b*.

Figure 3:
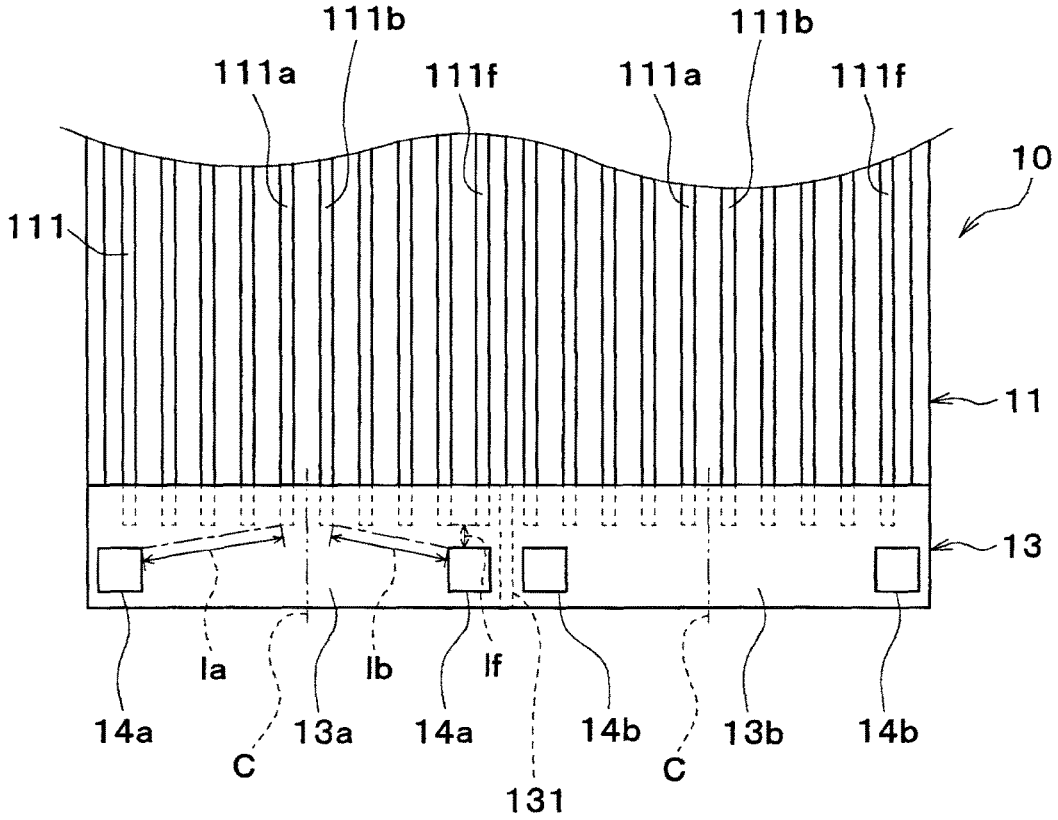
FIG. 3 is an explanatory drawing for explaining a spatial relationship among a plurality of tubes, which forms each core part of an AU core part, and each refrigerant inlet according to the first embodiment.

As shown in FIG. 2 and FIG. 3, the first AU tank part 13 is connected with the first distribution part combination member 32*a*, and is connected with two first refrigerant inlets 14*a* which make the refrigerant from the first distribution part connecting member 32*a* flows into the first distribution part 13*a*, and is connected with the second distribution part connecting member 32*b*, and is formed with two second refrigerant inlets 14*b* which make the refrigerant from the second distribution part connecting member 32*b* flows into the second distribution part 13*b*.

One first refrigerant inlet 14*a* among two first refrigerant inlets 14*a* is disposed on an end of the first distribution part 13*a* on a near side to the refrigerant outlet part 12*a* in the tube stacking direction. The other one first refrigerant inlet 14*a* is disposed on an end of the first distribution part 13*a* on a far side from the refrigerant outlet part 12*a* in the tube stacking direction.

One second refrigerant inlet 14*b* among two second refrigerant inlets 14*b* is disposed on an end of the second distribution part 13*b* on a near side to the refrigerant outlet part 12*a* in the tube stacking direction. The other one second refrigerant inlet 14*b* is disposed on an end of the second distribution part 13*b* on a far side from the refrigerant outlet part 12*a* in the tube stacking direction.

Returning to FIG. 2, the middle tank part 33 is configured by a cylindrical member with closed both ends. The middle tank part 33 is arranged between the second AU tank part 13 and the second AD tank part 23. The middle tank part 33 of this embodiment is arranged so that a one part thereof, i.e., an upper side part, overlaps with the second AU tank part 13 and the second AD tank part 23, and is arranged so that the other one part thereof, i.e., a lower side part, does not overlap with the second AU tank part 13 and the second AD tank part 23, when viewing from the flow direction X of the flowing air.

Thus, it is possible to achieve an advantage of reducing size by arranging the part of the middle tank part 33 not to overlap with the second AU tank part 13 and the second AD tank part 23. Specifically, in the flow direction X of the flowing air, the first evaporating portion 10 and the second evaporating portion 20 can be arranged in a closely arranged configuration. Therefore, it is possible to suppress increase of size of the refrigerant evaporator 1 caused by disposing the middle tank part 33.

Figure 4:
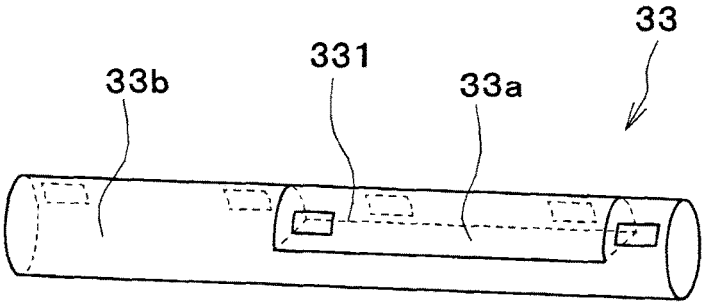
FIG. 4 is a schematic perspective view of a middle tank part in the first embodiment.
Figure 5:
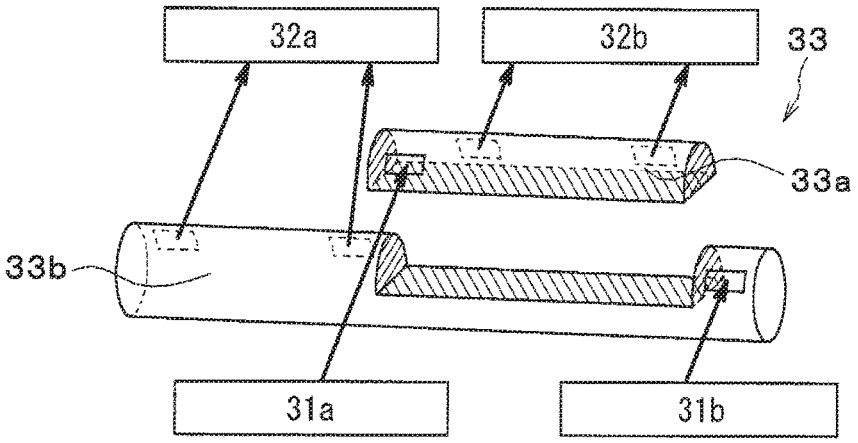
FIG. 5 is an exploded perspective view of the middle tank part shown in FIG. 4.

As shown in FIG. 4 and FIG. 5, the partition member 331 is arranged in an inside of the middle tank part 33 at a position located in the upper side, and a space within the tank inside is separated into the first refrigerant flow passage 33*a* and the second refrigerant flow passage 33*b*.

The first refrigerant flow passage 33*a* configures the refrigerant flow passage which leads the refrigerant from the first collecting part connecting member 31*a* to the second distribution part connecting member 32*b*. On the other hand, the second refrigerant flow passage 33*b* configures the refrigerant flow passage which leads the refrigerant from the second collecting part connecting member 31*b* to the first distribution part connecting member 32*a*.

Here, the first collecting part connecting member 31*a*, the second distribution part connecting member 32*b*, and the first refrigerant flow passage 33*a* in the middle tank part 33 configure the first communicating portion in this embodiment. In addition, the second collecting part connecting member 31*b*, the first distribution part connecting member 32*a*, and the second refrigerant flow passage 33*b* in the middle tank part 33 configure the second communicating portion.

Figure 6:
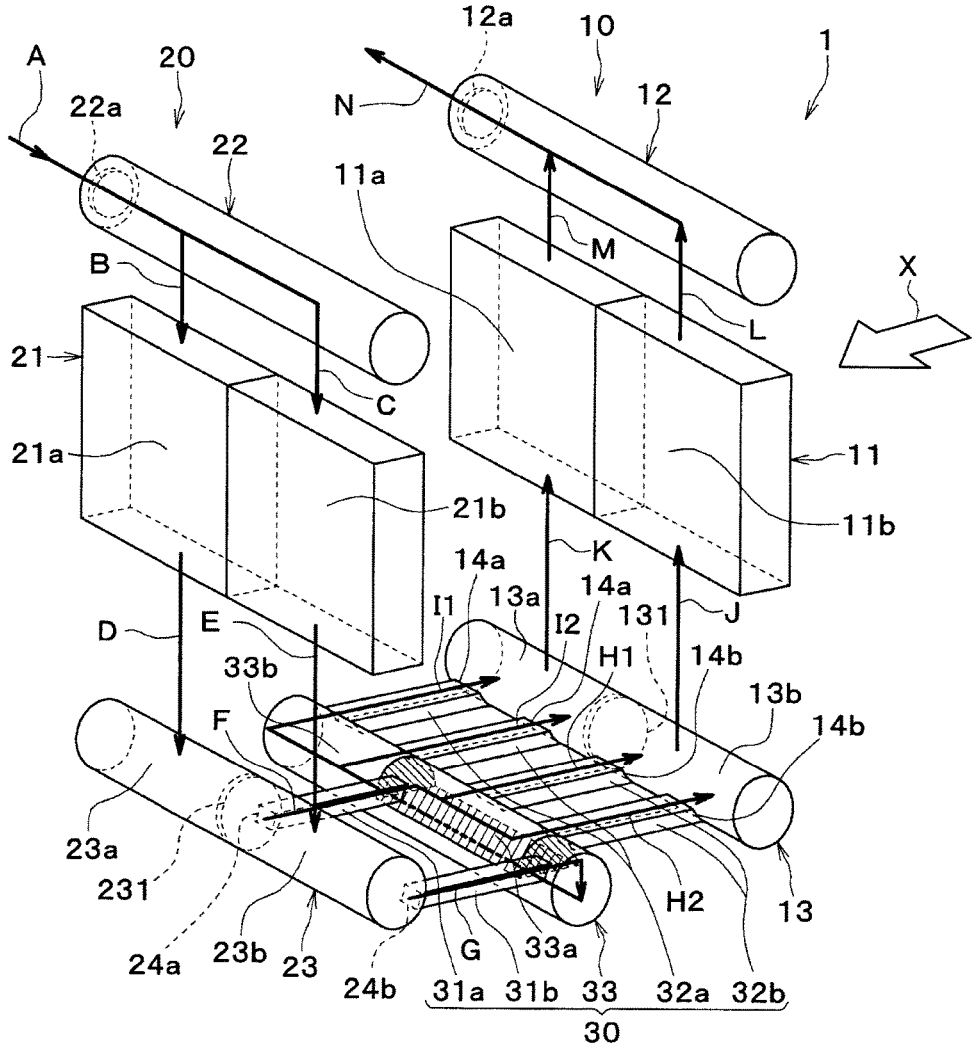
FIG. 6 is an explanatory drawing for explaining refrigerant flow in the refrigerant evaporator according to the first embodiment.

Next, flow of the refrigerant in the refrigerant evaporator 1 according to this embodiment is explained by using FIG. 6.

As shown in FIG. 6, the low pressure refrigerant decompressed in the expansion valve, not shown, is introduced into the tank inside from a refrigerant inlet part 22*a* formed on the one end side of the first AD tank part 22 as shown by an arrow symbol A. The refrigerant introduced into an inside of the first AD tank part 22 descends the first AD core part 21*a* of the AD core part 21 as shown by an arrow symbol B, and also, descends the second AD core part 21*b* of the AD core part 21 as shown by an arrow symbol C.

The refrigerant descended in the first AD core part 21*a* flows into the first collecting part 23*a* of the second AD tank part 23 as shown by an arrow symbol D. On the other hand, the refrigerant descended in the second AD core part 21*b* flows into the second collecting part 23*b* of the second AD tank part 23 as shown by an arrow symbol E.

The refrigerant entered into the first collecting part 23*a* flows into the first refrigerant flow passage 33*a* of the middle tank part 33 through the first collecting part connecting member 31*a* as shown by an arrow symbol F. In addition, the refrigerant entered into the second collecting part 23*b* flows into the second refrigerant flow passage 33*b* of the middle tank part 33 through the second collecting part connecting member 31*b* as shown by an arrow symbol G.

The refrigerant entered into the first refrigerant flow passage 33*a* flows into the second distribution part 13*b* of the second AU tank part 13 through two second distribution part connecting members 32*b* as shown by an arrow symbol H1 and the arrow symbol H2. In addition, the refrigerant entered into the second refrigerant flow passage 33*b* flows into the first distribution part 13*a* of the second AU tank part 13 through two first distribution part connecting members 32*a* as shown by an arrow symbols L1 and L2.

The refrigerant entered into the second distribution part 13*b* of the second AU tank part 13 flows upwardly in the second AU core part 11*b* of the AU core part 11 as shown by an arrow symbol J. On the other hand, the refrigerant entered into the first distribution part 13*a* goes up the first AU core part 11*a* of the AU core part 11 as shown by an arrow symbol K.

The refrigerant which went up the second AU core part 11*b* and the refrigerant which went up the first AU core part 11*a* flow into an tank inside of the first AU tank part 12 as shown by arrow symbols L and M respectively, and are led from the refrigerant outlet part 12*a* formed on one end of the first AU tank part 12 to an intake side of the compressor, not shown, as shown by an arrow symbol N.

In the above mentioned refrigerant evaporator 1 according to the embodiment, two or more first refrigerant inlets 14*a* which make the refrigerant from the second AU core part 21*b* flow into the first distribution part 13*a* are disposed on the first distribution part 13*a*. Accordingly, as compared with a case where one first refrigerant inlet 14*a* is disposed, it is possible to shorten a distance between an end of the tube 111 most distanced from the first refrigerant inlet 14*a* and the first refrigerant inlet 14*a*.

As mentioned above, a pressure loss of the refrigerant is lowered and an amount of the refrigerant flowing into the tube 111 is increased, as the distance of the first refrigerant inlet 14*a* and the end of the tube 111 becomes short. Accordingly, as compared with a refrigerant evaporator where one first refrigerant inlet 14*a* is disposed, in a case of the refrigerant evaporator 1 according to this embodiment, since the distance between the first refrigerant inlet 14*a* and the end of the tube 111 mostly distanced from the first refrigerant inlet 14*a* becomes short, the refrigerant amount flowing into the tube 111 is increased.

Thereby, it is possible to suppress a leaning of the refrigerant amount flowing into each of the tubes 111 forming the first AU core part 11*a*, therefore it becomes possible to suppress distribution in which a liquid phase refrigerant is distributed in a leaning manner within the first AU core part 11*a*. Therefore, it becomes possible to suppress lowering of the cooling capability of the fluid at the refrigerant evaporator 1.

Specifically, in this embodiment, two first refrigerant inlets 14*a* are arranged on one side and the other side of the centerline C in the stacking direction of the tubes 111 in the first distribution part 13*a* as shown in FIG. 3. In this embodiment, two first refrigerant inlets 14*a* are symmetrically arranged to the centerline C of the tube 111 lamination direction in the first distribution part 13*a*.

In detail, two first refrigerant inlets 14*a* are disposed on an end of the first distribution part 13*a* on a near side to the refrigerant outlet part 12*a* in the tube stacking direction, and on an end of the first distribution part 13*a* on a far side from the refrigerant outlet part 12*a* in the tube stacking direction, respectively.

In other words, an inter-refrigerant-inlet-distance La and an inter-refrigerant-inlet-distance Lb are substantially equal to each other. An inter-refrigerant-inlet-distance is a distance to a refrigerant inlet 14*a* arranged most closely among two first refrigerant inlets 14*a* from the plurality of tubes 111 for the first AU core part 11*a*. The inter-refrigerant-inlet-distance La is obtained at the tube 111*a* at which the inter-refrigerant inlet distance becomes the maximum to one of the refrigerant inlet 14*a*, i.e., the left side on the drawing, among two first refrigerant inlets 14*a*. The inter-refrigerant-inlet-distance Lb is obtained at the tube 111*b* at which the inter-refrigerant-inlet-distance becomes the maximum to the other one of the refrigerant inlet 14*a*, i.e., the right side on the drawing.

Thereby, it is possible to further decrease a leaning of the refrigerant amount flowing into each of the tubes 111 forming the first AU core part 11*a*, therefore it becomes possible to surely suppress distribution in which a liquid phase refrigerant is distributed in a leaning manner within the first AU core part 11*a*.

In addition, in this embodiment, the first distribution part connecting member 32*a* and the second distribution part connecting members 32*b* are disposed as a multiple of two pairs. Comparing with the refrigerant evaporator 1 in which each connecting members 32*a* and 32*b* are disposed as a single pair, it is possible to reduce the mass flow rate of the refrigerant per unit areal in the distribution part connecting members 32*a* and 32*b*, respectively. Accordingly, since the refrigerant pressure loss in each distribution part connecting members 32*a* and 32*b* is reduced, it becomes possible to improve the cooling capability of the fluid to be cooled.

By the way, in a case of the refrigerant evaporator 1 formed with a single first refrigerant inlet 14*a*, a flow velocity of the refrigerant entered from the first refrigerant inlet 14*a* is increased, and it becomes easy to be influenced by the inertia force of flow. Accordingly, as a refrigerant amount increases, a refrigerant amount flowing to the far side from the first refrigerant inlet 14*a* increases, therefore, a leaning of distribution of the liquid phase refrigerant becomes great.

Contrary, in this embodiment, the number of the first refrigerant inlets 14*a*, i.e., two, is increased to the number of the second refrigerant outlets 24*b*, i.e., one, as shown in FIG. 2. Thereby, since it is possible reduce the flow velocity of the refrigerant entering into the first distribution part 13*a*, it becomes possible to suppress worsening of the refrigerant distribution caused by the inertia force of flow.

Here, among a plurality of tubes 111 which form the first AU core part 11*a*, the tube arranged at the furthest position from the refrigerant outlet part 12*a* is called as an outlet furthest tube 111*f*. In this case, in this embodiment, as shown in FIG. 3, an inter refrigerant inlet distance Lf at the outlet furthest tube 111*f* is shorter than the inter refrigerant inlet distances at tubes 111 other than the outlet furthest tube 111*f* among the plurality of tubes 111 forming the first AU core part 11*a*.

Thereby, since it is possible to suppress a leaning of the pressure loss of the refrigerant in each refrigerant passage from the first refrigerant inlet 14*a* to the refrigerant outlet part 12*a* through each tube 111, it becomes possible to suppress worsening of refrigerant distribution.

In addition, in this embodiment, two second refrigerant inlets 14*b* are also arranged in a similar manner to an arrangement for the first refrigerant inlet 14*a*, i.e., are also arranged on an end of the first distribution part 13*a* on a near side to the refrigerant outlet part 12*a* in the tube stacking direction, and on an end of the first distribution part 13*a* on a far side from the refrigerant outlet part 12*a* in the tube stacking direction. Accordingly, it becomes possible to suppress distribution in which a liquid phase refrigerant is distributed in a leaning manner within the second AU core part 11*b* too, similar to the first AU core part 11*a*.

Second Embodiment

The second embodiment of this invention is explained with reference to FIG. 7. The second embodiment differs in arrangement of the first refrigerant inlet 14*a* and the second refrigerant inlet 14*b* as compared with the above-mentioned first embodiment.

Figure 7:
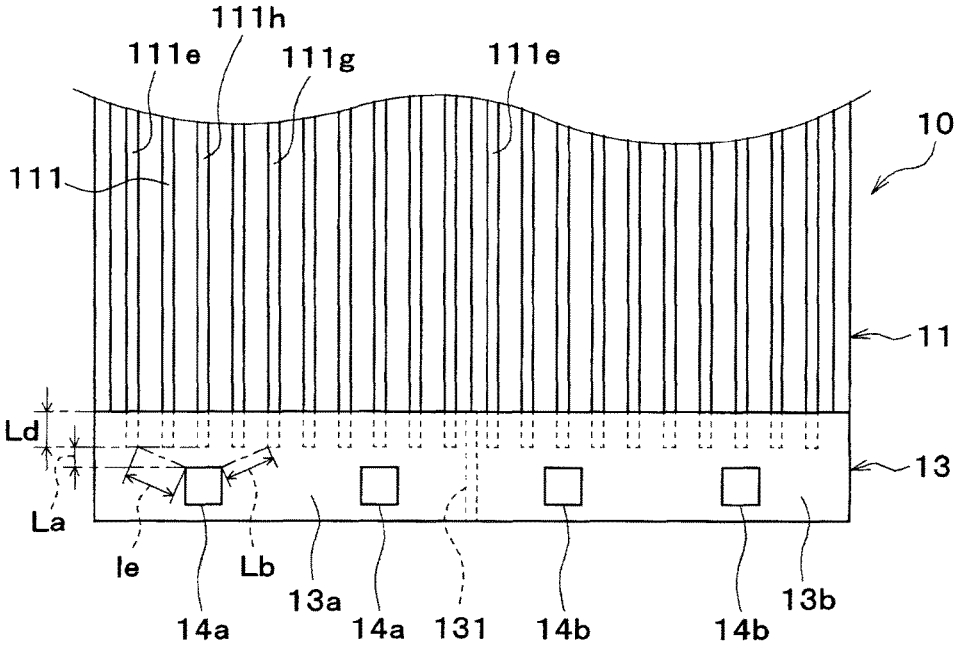
FIG. 7 is an explanatory drawing for explaining a spatial relationship among a plurality of tubes, which forms each core part of an AU core part, and each refrigerant inlet according to a second embodiment.

As shown in FIG. 7, two of the first refrigerant outlets 14*a* of this embodiment are formed in a spaced apart manner with a distance on an inside portion rather than the both ends in the tube stacking direction on the first distribution part 13*a* of the second AU tank part 13.

Here, among a plurality of tubes 111 forming the first AU core part 11*a*, a tube 111 most distanced from the first refrigerant inlet 14*a* is called a furthest tube 111*g*, and a tube 111 nearest to the first refrigerant inlet 14*a* is called a nearest tube 111*h*. In addition, among a plurality of tubes 111 forming the first AU core part 11*a*, a tube arranged on a nearest position to the refrigerant outlet part 12*a* is called an outlet nearest tube 111*e*.

In this embodiment, two first inlets 14*a* are arranged so that distances between the first refrigerant inlet 14*a* and all the tubes 111 forming the first AU core part 11 are almost equal. Specifically, two first inlets 14*a* are arranged in positions to satisfy a relationship La<=Lb<=La+Ld, where a distance from the nearest tube 111*h* to the first refrigerant inlet 14*a* is La, a distance from the furthest tube 111*g* to the first refrigerant inlet 14*a* is Lb, and a length of a part located in the inside of the first distribution part 13*a* of the nearest tube 111*h* is Ld.

According to this, since it is possible to shorten the maximum value of the refrigerant inlet distance of the tube 111 forming the first AU core part 11*a*, it is possible to reduce a leaning of the pressure loss of the refrigerant flowing into each tube 111. Accordingly, it becomes possible to suppress that a liquid phase refrigerant is distributed in a leaning manner in the first AU core part 11*a*.

In addition, in this embodiment, the inter-refrigerant-inlet-distance Le at the outlet nearest tube 111*e* is longer than the inter-refrigerant-inlet-distances at the tubes 111 except for the outlet nearest tube 111*e* among a plurality of tubes 111 forming the first AU core part 11*a*.

Thereby, since it is possible to suppress a leaning of the pressure loss of the refrigerant in each refrigerant passage from the first refrigerant inlet 14*a* to the refrigerant outlet part 12*a* through each tube 111, it becomes possible to suppress worsening of refrigerant distribution.

In this embodiment, two second inlets 14*b* are also arranged similar to the first inlets 14*a*, i.e., are arranged so that distances between the second refrigerant inlet 14*b* and all the tubes 111 forming the second AU core part 11*b* are almost equal. Accordingly, it becomes possible to suppress distribution in which a liquid phase refrigerant is distributed in a leaning manner within the second AU core part 11*b* too, similar to the first AU core part 11*a*.

Third Embodiment

Figure 8:
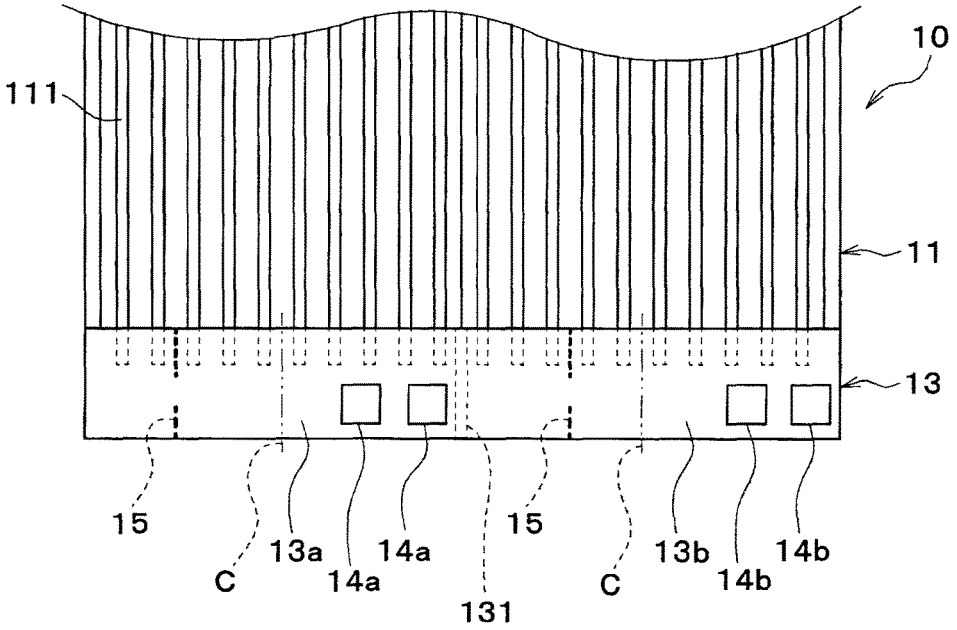
FIG. 8 is an explanatory drawing for explaining a spatial relationship among a plurality of tubes, which forms each core part of an AU core part, and each refrigerant inlet according to a third embodiment.

The third embodiment of the invention is explained reference to FIG. 8. The third embodiment differs in arrangement of the first refrigerant inlet 14*a* and the second refrigerant inlet 14*b* as compared with the above-mentioned first embodiment.

As shown in FIG. 8, two first refrigerant inlets 14*a* are arranged on one side, on the right side of the drawing, to a center line C in the stacking direction of the tubes 111 on the first distribution part 13*a*. In addition, a throttle plate 15 as a flow amount adjustor which adjusts the refrigerant flow amount flowing through the inside of the first distribution part 13*a* is disposed on the other side, on the drawing, to the center line C on the first distribution part 13*a*.

According to this embodiment, since the refrigerant entering from two first refrigerant inlets 14*a* is spread when it passes the throttle plate 15 in the first distribution part 13*a*, the distribution of the refrigerant in the first distribution part 13*a* can be improved. Accordingly, it becomes possible to suppress that a liquid phase refrigerant is distributed in a leaning manner in the first AU core part 11*a*.

In addition, in this embodiment, two second refrigerant inlets 14*b* are also arranged in a similar arrangement to the first refrigerant inlets 14*a*, i.e., are arranged on one side, right side on the drawing, to the center line C in the stacking direction of the tubes 111 in the second distribution part 13*b*. Further, a throttle plate 15 is arranged on the other side, on the drawing, to the center line C in the second distribution part 13*b* too. Accordingly, it becomes possible to suppress distribution in which a liquid phase refrigerant is distributed in a leaning manner within the second AU core part 11*b* too, similar to the first AU core part 11*a*.

Fourth Embodiment

The fourth embodiment for practicing the invention is explained referring to the drawings. The refrigerant evaporator 1 is disposed in the vehicle air-conditioner which adjusts the temperature of a vehicle compartment. The refrigerant evaporator 1 is a heat exchanger for cooling the air supplied to the compartment. The refrigerant evaporator 1 is a low-pressure side heat exchanger in the vapor compressing type refrigeration cycle. The refrigerant evaporator 1 evaporates the refrigerant, i.e., a liquid phase refrigerant, by absorbing heat from the air supplied to the compartment. The air supplied to the compartment is a fluid to be cooled flowing outside of the refrigerant evaporator 1.

The refrigerant evaporator 1 is one of components of the refrigeration cycle. The refrigeration cycle may have components which are not illustrated, such as a compressor, a condenser, and an expansion device. For example, the refrigeration cycle is a receiver cycle which has a receiver between the condenser and the expansion device.

Figure 9:
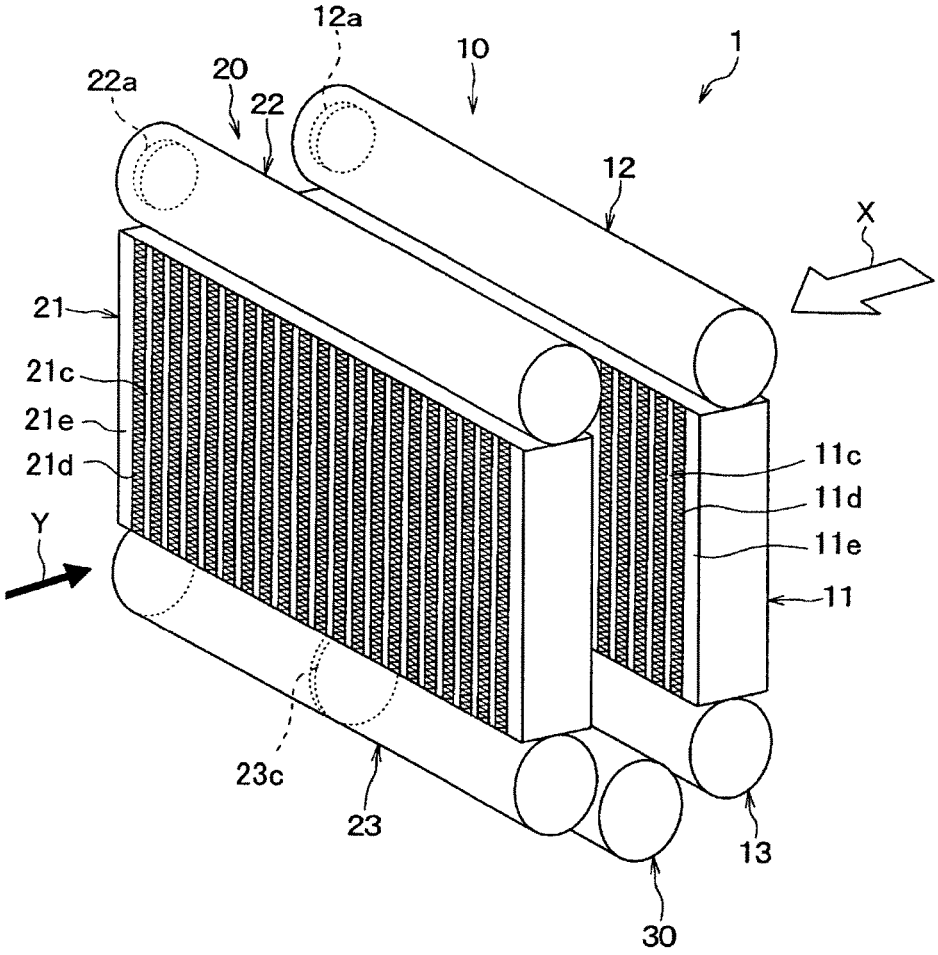
FIG. 9 is a perspective view of a refrigerant evaporator according to a fourth embodiment.
Figure 10:
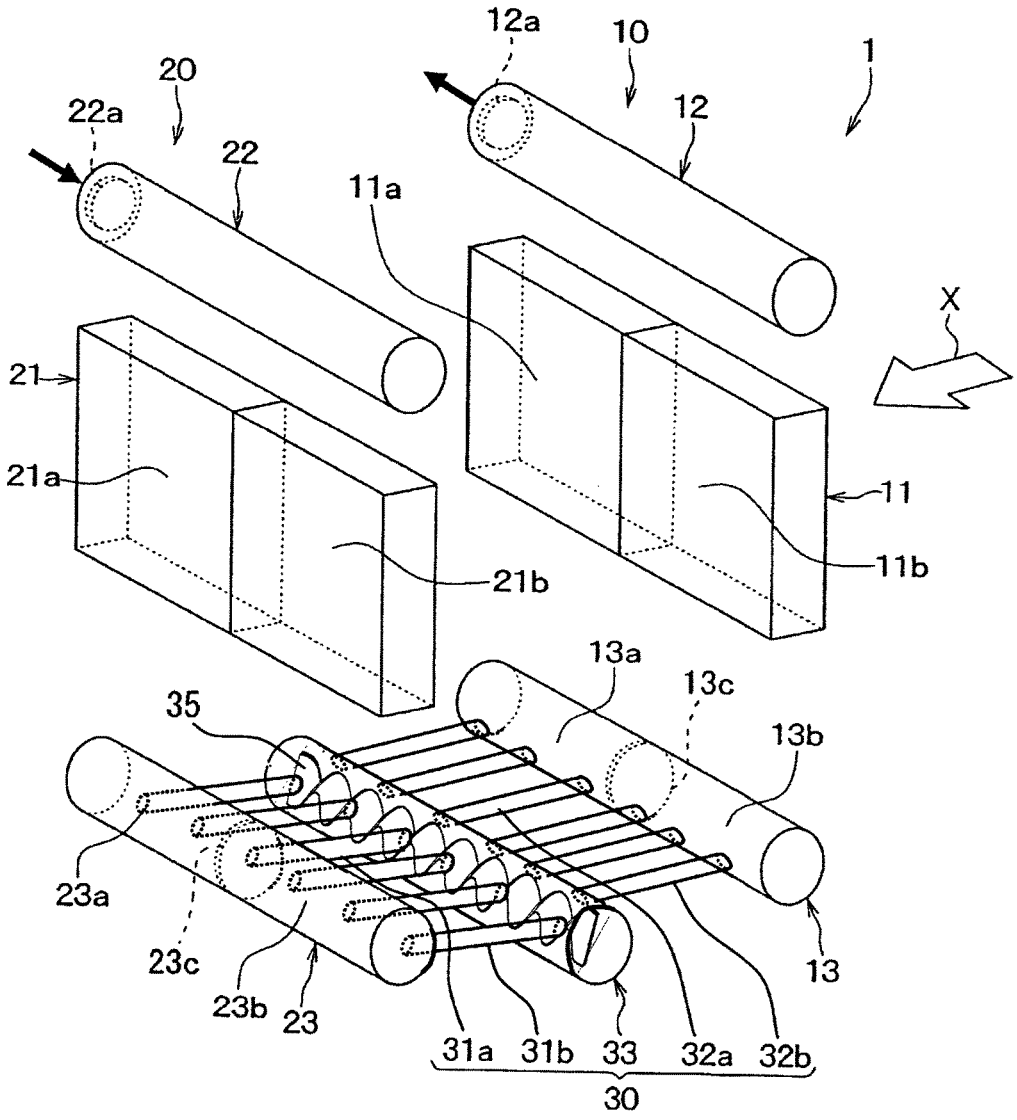
FIG. 10 is an exploded perspective view of the refrigerant evaporator according to the fourth embodiment.

In FIG. 9, the refrigerant evaporator 1 is illustrated schematically. In FIG. 10, a plurality of components of the refrigerant evaporator 1 is illustrated. In the drawings, the tubes 11*c* and 21*c* and the fins 11*d* and 21*d* are not illustrated.

As shown in the drawing, the refrigerant evaporator 1 has two evaporating portions 10 and 20. Two evaporating portions 10 and 20 are arranged in series at an upstream side and a downstream side with respect to a flow direction of air, i.e., a flow direction X of the fluid to be cooled. An evaporating portion 10 arranged at the upstream side of the air flow direction X is also called as a windward side evaporating portion 10. Hereafter, the windward side evaporating portion 10 is called as an AU evaporating portion 10. The evaporating portion 20 arranged at the downstream side of the air flowing direction X is called as a leeward side evaporating portion 20. Hereafter, the downstream evaporating portion 20 is called as an AD evaporating portion 20.

Two evaporating portions 10 and 20 are arranged on an upstream side and a downstream side with respect to a flow direction of the refrigerant. The refrigerant flows through the AU evaporating portion 10, after flowing through the AD evaporating portion 20. When viewing it about the refrigerant flow direction, the AD evaporating portion 20 is called a first evaporating portion, and the AU evaporating portion 10 is called a second evaporating portion. Since the AD evaporating portion 20 is arranged on the upstream about the refrigerant flow direction, it may be also called as a refrigerant upstream evaporating portion 20. Since the AU evaporating portion 10 is arranged on the downstream about the refrigerant flow direction, it may be also called as a refrigerant downstream evaporating portion 10. By using the refrigerant evaporator 1, a counter-flow-heat-exchanger in which the refrigerant flow direction and the air flow direction are in opposite as a whole is provided.

The fundamental structure of the AU evaporating portion 10 and the AD evaporating portion 20 is the same. The AU evaporating portion 10 has a core part 11 for heat exchange and a pair of tank parts 12 and 13 arranged on both ends of the core part 11. The AD evaporating portion 20 has a core part 21 for heat exchange and a pair of tank parts 22 and 23 arranged on both ends of the core part 21.

The core part 11 in the AU evaporating portion 10 is called as an AU core part 11. The core part 21 in the AD evaporating portion 20 is called as an AD core part 21. A pair of tank parts 12 and 13 in the AU evaporating portion 10 has a first AU tank part 12 arranged on the up side and a second AU tank part 13 arranged on the lower side. Similarly, a pair of tank parts 22 and 23 in the AD evaporating portion 20 has a first AD tank part 22 arranged on the up side and a second AD tank part 23 arranged on the lower side.

The AU core part 11 and the AD core part 21 have a plurality of tubes 11*c* and 21*c* and a plurality of fins 11*d* and 21*d*. The AU core part 11 and the AD core part 21 are configured by stacked member in which the plurality of tubes 11*c* and 21*c* and the plurality of fins 11*d* and 21*d* are stacked alternately. The plurality of tubes 11*c* communicate between a pair of tank parts 12 and 13. The plurality of tubes 21*c* communicate between a pair of tank parts 22 and 23. In the drawing, the plurality of tubes 11*c* and 21*c* extend a top-and-bottom direction. The plurality of fins 11*d* and 21*d* are arranged between adjacent tubes 11*c* and 21*c*, and are joined to them. In the following description, a stacking direction of the plurality of tubes 11*c* and 21*c* and the plurality of fins 11*d* and 21*d* in the stacked member is called a tube stacking direction.

The AU core part 11 has the first AU core part 11*a* and the second AU core part 11*b*. The first AU core part 11*a* is configured by a part of the plurality of tubes 11*c*. The first AU core part 11*a* is configured by a group of tubes 11*c* arranged along a line to form a single row. The second AU core part 11*b* is configured by a remaining part of the plurality of tubes 11*c*. The second AU core part 11*b* is configured by a group of tubes 11*c* arranged along a line to form a single row. The first AU core part 11*a* and the second AU core part 11*b* are aligned in the tube stacking direction. The first AU core part 11*a* is configured by a group of tubes arranged on the right side in the tube stacking direction when viewing it along the air flow direction X. The second AU core part 11*b* is configured by a group of tubes arranged on the left side of the tube stacking direction when viewing it along the air flow direction X. The first AU core part 11*a* is arranged closer to a refrigerant outlet 12*a* of the tank part 12 than the second AU core part 11*b*.

The tank part 12 is a last collecting tank positioned on the most downstream on the refrigerant flow within the refrigerant evaporator 1. The tank part 12 is a collecting part which is disposed on a downstream end of the refrigerant of the plurality of tubes 11*c* forming the AU core part 11, and collects the refrigerant passed the AU core part 11. The tank part 12 provides an outlet collecting part which has a refrigerant outlet 12*a* on the downstream end in the flow direction of the refrigerant.

The AD core part 21 has the first AD core part 21*a* and the second AD core part 21*b*. The first AD core part 21*a* is configured by a part of the plurality of tubes 21*c*. The first AD core part 21*a* is configured by a group of tubes 21*c* arranged along a line to form a single row. The second AD core part 21*b* is configured by a remaining part of the plurality of tubes 21*c*. The second AD core part 21*b* is configured by a group of tubes 21*c* arranged along a line to form a single row. The first AD core part 21*a* and the second AD core part 21*b* are aligned in the tube stacking direction. The first AD core part 21*a* is configured by a group of tubes arranged on the right side in the tube stacking direction, when viewing it along the air flow direction X. The second AD core part 21*b* is configured by a group of tubes arranged on the left side in the tube stacking direction, when viewing it along the air flow direction X. The first AD core part 21*a* is arranged closer to a refrigerant inlet 22*a* of the tank part 22 than the second AD core part 21*b*.

The tank part 22 is a first distribution tank positioned on the most upstream on the refrigerant flow within the refrigerant evaporator 1. The tank part 22 is disposed on the upstream end of the refrigerant of the plurality of tubes 11*c* forming the AD core part 21. The tank part 22 is a distribution part which distributes the refrigerant to the plurality of tubes 21*c* forming the AD core part 21. The tank part 22 provides an inlet distribution part which has a refrigerant inlet 22*a* on the upstream end in the flow direction of the refrigerant.

The first AD core part 21*a* is also called as a first core part. The second AD core part 21*b* is also called as a second core part. The first AU core part 11*a* is also called as a third core part. The second AU core part 11*b* is also called as a fourth core part.

The AU core part 11 and the AD core part 21 are arranged to overlap each other with respect to the air flow direction X. In other words, the AU core part 11 and the AD core part 21 opposes with respect to the air flow direction X. The first AU core part 11*a* and the first AD core part 21*a* are arranged to overlap each other with respect to the air flow direction X. In other words, the first AU core part 11*a* and the first AD core part 21*a* opposes with respect to the air flow direction X. The second AU core part 11*b* and the second AD core part 21*b* are arranged to overlap each other with respect to the air flow direction X. In other words, the second AU core part 11*b* and the second AD core part 21*b* opposes with respect to the air flow direction X.

Each of the plurality of tubes 11*c* and 21*c* defines and forms a passage which flow the refrigerant therein. Each of the plurality of tubes 11*c* and 21*c* is a flat tube. Each of the plurality of tubes 11*c* and 21*c* is arranged so that a flat cross section extends along the air flow direction X.

The tubes 11*c* of the AU core part 11 are connected with the first AU tank part 12 at one ends, i.e., at upper ends, in the longitudinal direction, and are also connected with the second AU tank part 13 at the other ends, i.e., at lower ends, in the longitudinal direction. The second AU tank part 13 provides a distribution part which distributes the refrigerant to the plurality of tubes 11*c*.

The tubes 21*c* of the AD core part 21 are connected with the first AD tank part 22 at one ends, i.e., at upper ends, in the longitudinal direction, and are also connected with the second AD tank part 23 at the other ends, i.e., at lower ends, in the longitudinal direction. The second AD tank part 23 provides a collecting part which collects the refrigerant from the plurality of tubes 21*c*.

Each of the plurality of fins 11*d* and 21*d* are joined to flat outer surfaces on the tubes 11*c* and 21*c*, and configures a heat exchange facilitating member for increasing a heat transfer area to the air. Each of the plurality of fins 11*d* and 21*d* is a corrugate fin. Each of the plurality of fins 11*d* and 21*d* is formed by bending a thin plate material into a wave shape.

Side plates 11*e* and 21*e*, which reinforce each of the core parts 11 and 12, are disposed on both ends of the stacking member of the tubes 11*c* and 21*c* and the fins 11*d* and 21*d* in the tube stacking direction. The side plates 11*e* and 21*e* are joined to the fins 11*d* and 21*d* arranged on the most outside in the tube stacking direction.

The first AU tank part 12 is configured by a cylindrical member. One end of the first AU tank part 12, i.e., the left end on a view along the air flow direction X is closed. The first AU tank part 12 has a refrigerant outlet 12*a* on the other end, i.e., the right end on a view along the air flow direction X. The refrigerant outlet 12*a* leads the refrigerant to an intake side of the compressor not illustrated from the inside of the tank. A plurality of through holes into which the one ends of the plurality of tubes 11*c* are inserted and joined are formed on a bottom of the first AU tank part 12 in the drawing. That is, the first AU tank part 12 is configured so that the inside chamber thereof communicates with the plurality of tubes 11*c* for the AU core part 11. The first AU tank part 12 works as a collecting part for collecting the refrigerant from the plurality of tubes 11*c* for the AU core part 11.

The first AD tank part 22 is configured by a cylindrical member. One end of the first AD tank part 22 is closed. The first AD tank part 22 has a refrigerant inlet 22*a* on the other end. The refrigerant inlet 22*a* introduces the low pressure refrigerant decompressed by the expansion valve not illustrated. A plurality of through holes into which the one ends of the plurality of tubes 21*c* are inserted and joined are formed on a bottom of the first AD tank part 22 in the drawing. That is, the first AD tank part 22 is configured so that the inside chamber thereof communicates with the plurality of tubes 21*c* for the AD core part 21. The first AD tank part 22 works as a distribution part for distributing the refrigerant to the plurality of tubes 21*c* for the AD core part 21.

The second AU tank part 13 is configured by a cylindrical member with closed both ends. A plurality of through holes into which the other ends of the plurality of tubes 11*c* are inserted and joined are formed on a top of the second AU tank part 13. That is, the second AU tank part 13 is configured so that the interior chamber thereof communicates with the plurality of tubes 11*c*. The second AU tank part 13 works as a distribution part for distributing the refrigerant to the plurality of tubes 11*c* for the AU core part 11.

A partition member 13*c* is arranged within an inside of the second AU tank part 13 at a center position in the longitudinal direction. The partition member 13*c* partitions an interior space of the second AU tank part 13 into the first distribution part 13*a* and the second distribution part 13*b*. The first distribution part 13*a* is a chamber which is communicated with the plurality of tubes 11*c* forming the first AU core part 11*a*. The first distribution part 13*a* supplies the refrigerant to the first AU core part 11*a*. The first distribution part 13*a* distributes the refrigerant to the plurality of tubes 11*c* forming the first AU core part 11*a*. The second distribution part 13*b* is a chamber which is communicated with the plurality of tubes 11*c* forming the second AU core part 11*b*. The second distribution part 13*b* supplies the refrigerant to the second AU core part 11*b*. The second distribution part 13*b* is a chamber which is communicated with the plurality of tubes 11*c* forming the second AU core part 11*b*. Therefore, the first distribution part 13*a* and the second distribution part 13*b* configure a continuous distribution tank part 13.

The second AD tank part 23 is configured by a cylindrical member with closed both ends. A plurality of through holes into which the one ends of the plurality of tubes 21*c* are inserted and joined are formed on a top of the second AD tank part 23. That is, the second AD tank part 23 is configured so that the interior chamber thereof communicates with the plurality of tubes 21*c*.

A partition member 23*c* is arranged within an inside of the second AD tank part 23 at a center position in the longitudinal direction. The partition member 23*c* partitions an interior space of the second AD tank part 23 into the first collecting part 23*a* and the second collecting part 23*b*. The first collecting part 23*a* is a chamber which is communicated with the plurality of tubes 21*c* forming the first AD core part 21*a*. The first collecting part 23*a* collects the refrigerant from the plurality of tubes 21*c* forming the first AD core part 21*a*. The second collecting part 23*b* is a chamber which is communicated with the plurality of tubes 21*c* forming the second AD core part 21*b*. The second collecting part 23*b* is a chamber which is communicated with the plurality of tubes 21*c* forming the second AD core part 21*b*. The second AD tank part 23 works as a collecting part which collects independently the refrigerant in the first AD core part 21*a*, and the refrigerants in the second AD core part 21*b*. Therefore, the first collecting part 23*a* and the second collecting part 23*b* configure a continuous collecting tank part 23.

Between the second AU tank part 13 and the second AD tank part 23 is connected through an interchange part 30. The interchange part 30 leads the refrigerant in the first collecting part 23*a* in the second AD tank part 23 to the second distribution part 13*b* in the second AU tank part 13. The interchange part 30 leads the refrigerant in the second collecting part 23*b* in the second AD tank part 23 to the first distribution part 13*a* in the second AU tank part 13.

That is, the interchange part 30 swaps the refrigerant flows so that the refrigerant passed through one part of the AD core part 21 flows through the other part of the AU core part 11. The one part of the AD core part 21 and the other part of the AU core part 11 do not overlap with respect to the air flow direction X. In other words, the interchange part 30 swaps the refrigerant flowing towards the second AU tank part 13 from the second AD tank part 23 crosses to the air flow direction X. That is, the interchange part 30 is configured to interchange the refrigerant flows in a core width direction in the core part 11 and the core part 21. The interchange part 30 provides a shifting communication part 30 which communicates two core parts which are positioned on positions not to overlap at least partially with respect to the air flow direction X, i.e., on different positions. The shifting communication part 30 communicates the upstream core parts 11*a* and 11*b* and the downstream core parts 21*a* and 21*b* which are positioned on positions not to overlap at least partially with respect to the flow direction X of the fluid to be cooled, and makes the refrigerant flows in an order thereof. The shifting communication part 30 forms the first passage 33*a* which communicates the first collecting part 23*a* and the second distribution part 13*b*, and the second passage 33*b* which communicates the second collecting part 23*b* and the first distribution part 13*a*.

The interchange part 30 provides the first communicating passage which guides the refrigerant passed through the first AD core part 21*a* to the second AU core part 11*b*, and the second communicating passage which guides the refrigerant passed through the second AD core part 21*b* to the first AU core part 11*a*. The first communicating passage and the second communicating passage cross.

Specifically, the interchange part 30 has the collecting part communicating portions 31*a* and 31*b*, the distribution part communicating portions 32*a* and 32*b*, and the middle tank part 33. The plurality of communicating portions 31*a*, 31*b*, 32*a*, and 32*b* may be provided by a cylindrical member in which a passage for passing the refrigerant is formed, or openings formed on the tank parts 23 and 33 and joined in a face-to-face manner.

The first collecting part communicating portion 31*a* communicates between the first collecting parts 23*a* in the second AD tank part 23 and the middle tank parts 33. The first collecting part communicating portion 31*a* is communicated to a first passage 33*a* in the middle tank part 33 mentioned later. At least one first collecting part communicating portion 31*a* is disposed between the first collecting part 23*a* and the first passage 33*a*.

The second collecting part communicating portion 31*b* communicates between the second collecting parts 23*b* in the second AD tank part 23 and the middle tank parts 33. The second collecting part communicating portion 31*b* is communicated to a second passage 33*b* within the middle tank part 33 mentioned later. At least one second collecting part communicating portion 31*b* is disposed between the second collecting part 23*b* and the second passage 33*b*.

The first distribution part communicating portion 32*a* communicates between the first distribution parts 13*a* in the second AU tank part 13 and the middle tank parts 33. The first distribution part communicating portion 32*a* is communicated to a second passage 33*b* in the middle tank part 33 mentioned later. At least one first distribution part communicating portion 32*a* is disposed between the first distribution part 13*a* and the second passage 33*b*.

The second distribution part communicating portion 32*b* communicates between the second distribution parts 13*b* in the second AU tank part 13 and the middle tank parts 33. The second distribution part communicating portion 32*b* is communicated to a first passage 33*a* in the middle tank part 33 mentioned later. At least one second distribution part communicating portion 32*b* is disposed between the second distribution part 13*b* and the first passage 33*a*.

The middle tank part 33 is connected with a plurality of collecting part communicating portions 31*a* and 31*b* and a plurality of distribution part communicating portions 32*a* and 32*b*. The plurality of collecting part communicating portions 31*a* and 31*b* provide inlets of the refrigerant in the interchange part 30. The plurality of distribution part communicating portions 32*a* and 32*b* provide outlets of the refrigerant in the interchange part 30. The interchange part 30 has a crossing passage in an inside thereof. The wall surface defining the passage gradually changes to swirl in a spiral manner along the flow direction of the refrigerant.

Figure 11:
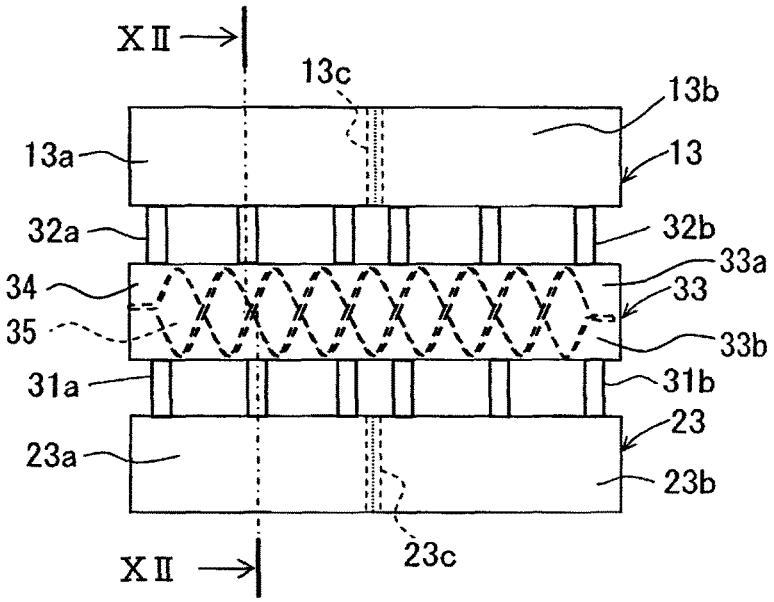
FIG. 11 is a plan view showing an arrangement of a plurality of tanks of a fourth embodiment.
Figure 12:
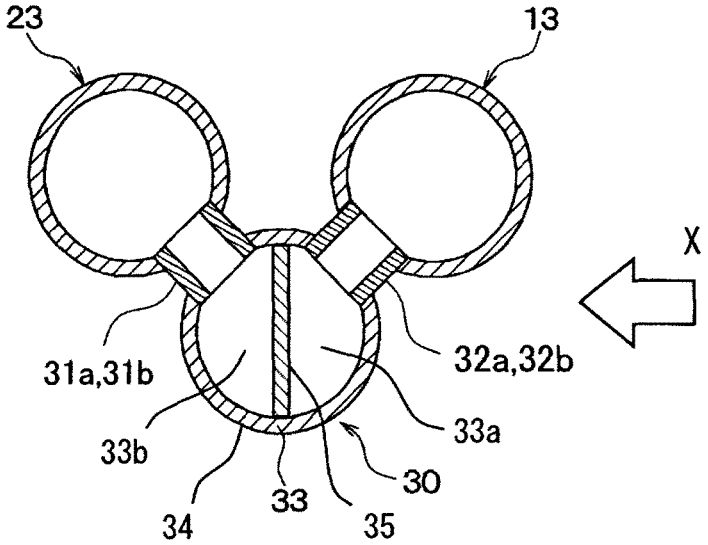
FIG. 12 is a cross sectional view showing an arrangement of a plurality of tanks of the fourth embodiment.
Figure 13:
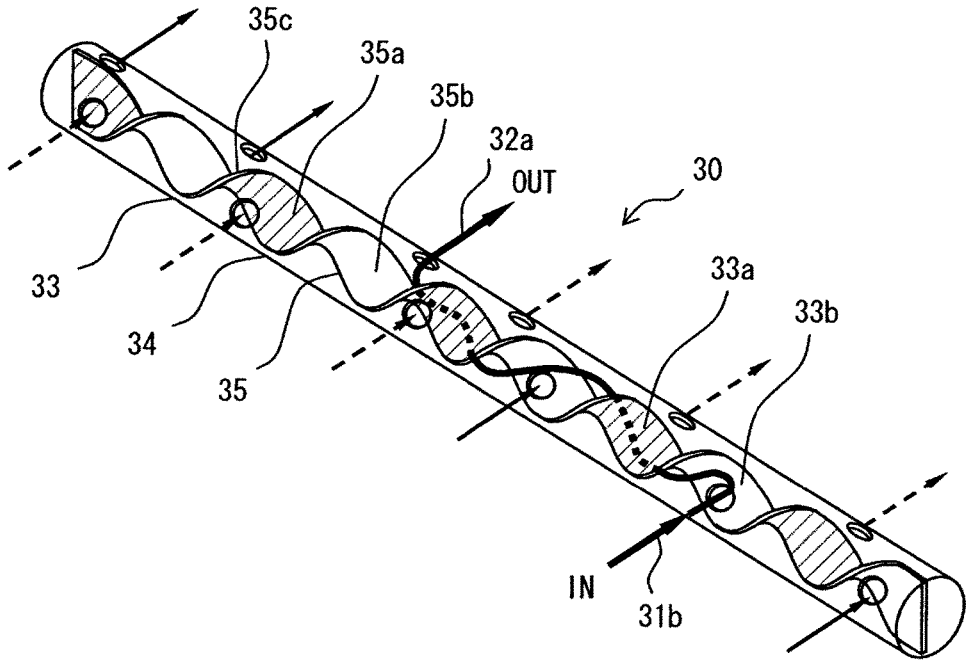
FIG. 13 is a perspective view showing a middle tank of the fourth embodiment.
Figure 14:
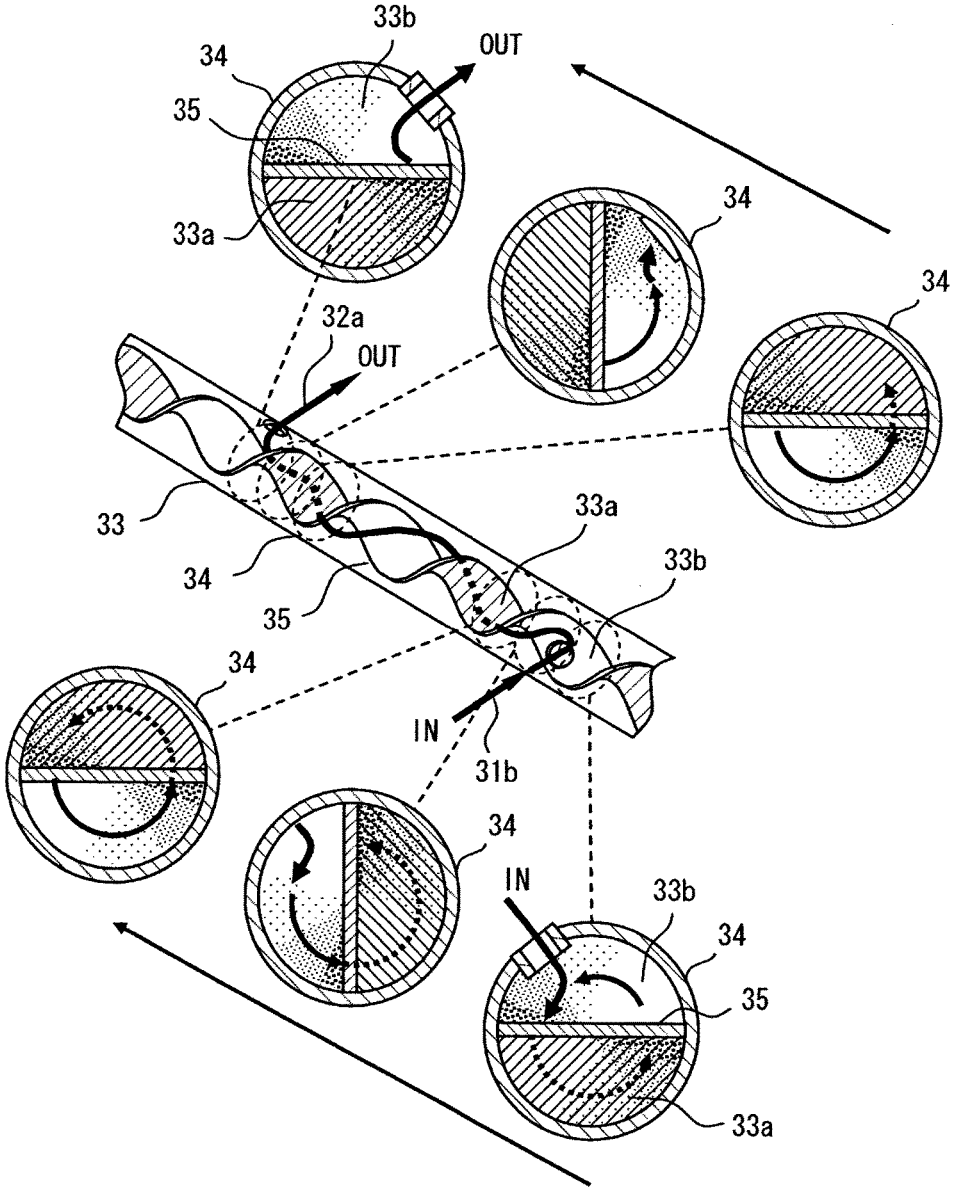
FIG. 14 is a combined cross sectional view showing transition of a shape of the middle tank of the fourth embodiment.

FIG. 11 is a plan view showing an arrangement of a plurality of tanks at a lower part of the refrigerant evaporator 1. FIG. 12 is a cross sectional view on a line XII-XII in FIG. 11. FIG. 13 is a perspective view showing a partition member 35 of a middle tank part 33. FIG. 14 shows a configuration of a passage formed in the middle tank part 33 and transition thereof. In the drawing, the partition member 35 is illustrated as a transparency. In the drawing, hatchings for identifying the front surface 35*a* and the back surface 35*b* of the partition member 35 are applied.

The middle tank part 33 has a cylindrical member 34 having closed both ends. The middle tank part 33 is arranged between the second AU tank part 13 and the second AD tank part 23. The middle tank part 33, when viewing it along the flow direction X of air, is arranged so that a one part of the middle tank part 33, i.e., an upper side part in the drawing overlaps with the second AU tank part 13 and the second AD tank part 23. The middle tank part 33, when viewing it along the flow direction X of air, is arranged so that the other part of the middle tank part 33, i.e., a lower side part in the drawing does not overlap with the second AU tank part 13 and the second AD tank part 23. In other words, the middle tank part 33 is arranged between the tank part 23 for collecting the refrigerant and the tank part 13 for distributing the refrigerant, and is arranged to overlap with the collecting tank part 23 and the distribution tank part 13 along the flow direction X of air. According to this structure, it is possible to decrease size of the collecting tank part 23, the distribution tank part 13, and the middle tank part 33.

This structure makes it possible to arrange the first evaporating portion 10 and the second evaporating portion 20 in a close relation with respect to the flow direction X of air. As a result, it is possible to suppress increase of size of the refrigerant evaporator 1 caused by disposing the middle tank part 33.

The middle tank part 33 is explained based on FIGS. 11 to 14. The middle tank part 33 has a cylindrical member 34 and a partition member 35. Both ends of the cylindrical member 34 are closed. The partition member 35 is accommodated and arranged in an inside of the cylindrical member 34. A shifting communication part 30 is provided by the cylindrical member 34 and the partition member 35.

As shown in FIG. 13, the partition member 35 is a long and narrow plate shape member having a width corresponding to an inner diameter of the cylindrical member 34, and a length corresponding to an overall length of the cylindrical member 34. The partition member 35 is joined to the inside of the cylindrical member 34. The partition member 35 partitions the inside of the cylindrical member 34 into a plurality of passages. The partition member 35 partitions the inside of the cylindrical member 34 into two passages, i.e., a first passage 33*a* and a second passage 33*b*. As a result, the middle tank part 33 defines the first passage 33*a* and the second passage 33*b* therein.

The partition member 35 is a plate shaped member and has a twisting part. The partition member 35 has a configuration where a plate member is spirally twisted around a center axis in a longitudinal direction of the plate member. As a result, the partition member 35 has a twisted configuration in which a front surface 35*a* and a back surface 35*b* alternately appear. The partition member 35 has at least one twisting part 35*c*. The partition member 35 is twisted at the twisting part 35*c*. In the illustrated example, the partition member 35 has a plurality of twisting parts 35*c*. One twisting part 35*c* is given by a twisting for 180 degrees angle to invert the front surface 35*a* and the back surface 35*b*. One twisting part 35*c* is formed with a twisting angle which is gradually twisted over a predetermined range in the longitudinal direction of the partition member 35. In the illustrated example, the partition member 35 is formed with a plurality of twisting parts 35*c* continuously arranged. As a result, the edge extended in the longitudinal direction of the partition member 35 extends spirally.

The first passage 33*a* and the second passage 33*b* extend in the longitudinal direction of the middle tank part 33 within the middle tank part 33. The first passage 33*a* and the second passage 33*b* extend in a spiral manner along about an axis of the longitudinal direction of the middle tank part 33. As a result, along with the longitudinal direction of the middle tank part 33, the first passage 33*a* and the second passage 33*b* appear alternately on the outside surface of the middle tank part 33.

The first passage 33*a* provides a passage which leads the refrigerant from the first collecting part connecting member 31*a* to the second distribution part connecting member 32*b*. The second passage 33*b* provides a passage which leads the refrigerant from the second collecting part connecting member 31*b* to the first distribution part connecting member 32*a*.

The first passage 33*a* in the first collecting part communicating portion 31*a*, the second distribution part communicating portion 32*b*, and the middle tank part 33 configures a first communicating portion. The first collecting part communicating portion 31*a* provides an inlet of the refrigerant in the first communicating portion. The second distribution part communicating portion 32*b* provides an outlet of the refrigerant in the first communicating portion.

The second passage 33*b* in the second collecting part communicating portion 31*b*, the first distribution part communicating portion 32*a*, and the middle tank part 33 configures a second communicating portion. The second collecting part communicating portion 31*b* provides an inlet of the refrigerant in the second communicating portion. The first distribution part communicating portion 32*a* provides an outlet of the refrigerant in the second communicating portion.

The first passage 33*a* and the second passage 33*b* are twisted in a spiral manner along the longitudinal direction of the middle tank part 33, i.e., along the flow direction of the refrigerant. In other words, the wall surface which defines the first passage 33*a* and the second passage 33*b* gradually changes in a spiral shape. In another viewpoint, the wall surface which defines the first passage 33*a* and the second passage 33*b* inclines along the flow direction of the refrigerant, and gradually changes to be inverted along the flow direction.

A low pressure refrigerant decompressed by the expansion valve, not illustrated, is supplied to the refrigerant evaporator 1, as shown to FIG. 10 by an arrow symbol. The refrigerant is introduced into the core of the first AD tank part 22 from the inlet 22*a* of the refrigerant formed on one end of the first AD tank part 22. The refrigerant is divided into two in the first AD tank part 22 which is the first distribution tank. The refrigerant descends the first AD core part 21*a* and also descends the second AD core part 21*b*. The refrigerant flows into the first collecting part 23*a*, after descending the first AD core part 21*a*. The refrigerant flows into the second collecting part 23*b*, after descending the second AD core part 21*b*. The refrigerant flows into the first passage 33*a* through the first collecting part communicating portion 31*a* from the first collecting part 23*a*. The refrigerant flows into the second passage 33*b* through the second collecting part communicating portion 31*b* from the second collecting part 23*b*.

FIG. 14 shows an example of refrigerant flow in the middle tank part 33 with arrow symbols. The refrigerant passed through the second collecting part communicating portion 31*b* flows into the second passage 33*b*. The partition member 35 defining the second passage 33*b* provides the surface wall which swirls along the flow direction. Therefore, the refrigerant flowing through the inside of the second passage 33*b* flows which swirling. As a result, a separation of gas component and liquid component of the refrigerant within the second passage 33*b*, i.e., a gas-liquid separation is suppressed. Then, the refrigerant flows out of the first distribution part communicating portion 32*a*.

No matter the refrigerant evaporator 1 is installed in any attitude, the swirling flow of the refrigerant in the interchange part 30 is acquired. Accordingly, component separation of the refrigerant is suppressed, without depending on the installation attitude of the refrigerant evaporator 1. When the refrigerant evaporator 1 is installed to place the interchange part 30 on the bottom of the refrigerant evaporator 1 as shown in the drawing, since the first and the second passages 33*a* and 33*b* formed in a spiral shape stir the refrigerant, it is advantageous in order to suppress accumulation of the liquid component.

The refrigerant flows into the second distribution part 13*b* through the second distribution part communicating portion 32*b* from the first passage 33*a*. The refrigerant flows into the first distribution part 13*a* through the first distribution part communicating portion 32*a* from the second passage 33*b*. The refrigerant goes up the second AU core part 11*b* from the second distribution part 13*b*. The refrigerant goes up the first AU core part 11*a* from the first distribution part 13*a*. The refrigerant flows into the inside of the first AU tank part 12 from the second AU core part 11*b*. The refrigerant flows into the inside of the first AU tank part 12 from the first AU core part 11*a*. Therefore, the refrigerant is unified into one flow within the first AU tank part 12 which is the last collecting tank. The refrigerant flows out to the outside of the refrigerant evaporator 1 from the outlet 12*a* formed on one end of the first AU tank part 12. Then, the refrigerant is supplied to the intake side of the compressor not illustrated.

According to this embodiment, the twisting part 35*c* makes the refrigerant to flow in a swirling manner. At the interchange part 30, the refrigerant flows while swirling. Accordingly, separation of refrigerant components in the interchange part 30 is suppressed. As a result, unevenness of a refrigerant component distribution in the AU core part 11 is suppressed. Further, unevenness of the temperature distribution in the AU core part 11 is suppressed.

Fifth Embodiment

Figure 15:
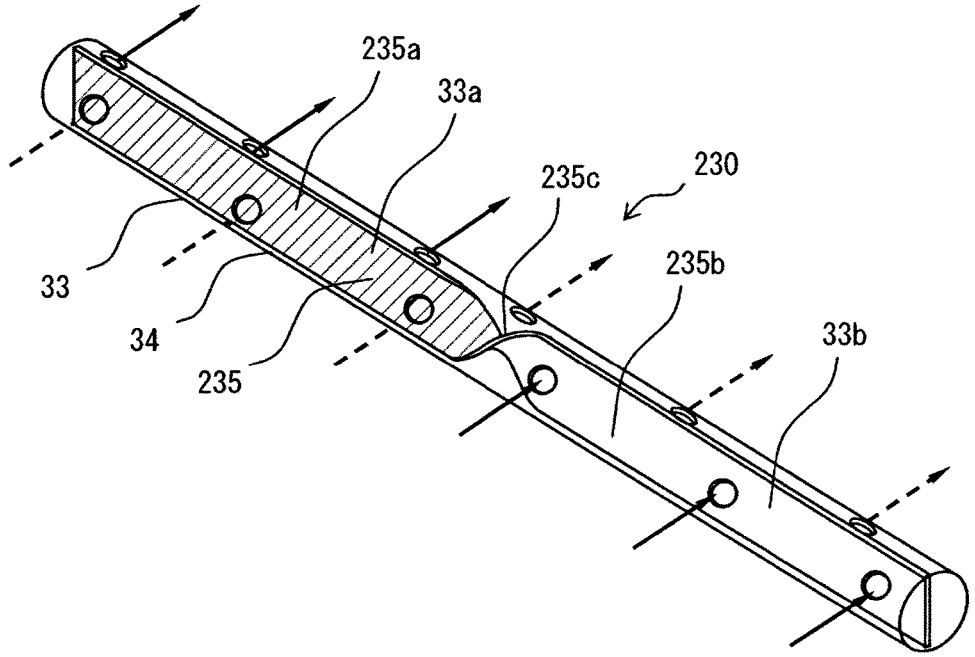
FIG. 15 is a perspective view showing a middle tank of the fifth embodiment.

This embodiment is one of modifications based on a basic form provided by the preceding embodiment. In the preceding embodiment, the partition member 35 with the plurality of twisting part 35*c* is used. Alternatively, in this embodiment, a partition member 235 illustrated in FIG. 15 is used.

The partition member 235 has one twisting part 235*c* on a center portion. The twisting part 235*c* gives a 180 degrees twisting so that a front surface 235*a* and a back surface 235*b* are reversed. According to this structure, the first passage 33*a* and the second passage 33*b* are interchanged at the twisting part 235*c*. According to this structure, a half of the first passage 33*a* is positioned to oppose with the first collecting part 23*a*. A remaining half of the first passage 33*a* is positioned to oppose the second distribution part 13*b*. Similarly, a half of the second passage 33*b* is positioned to oppose the second collecting part 23*b*. A remaining half of the second passage 33*b* is positioned to oppose the first distribution part 13*a*.

According to this structure, the partition member 235 has the twisting part 235*c* on a center of the first passage 33*a*. Therefore, it is possible to swirl the refrigerant within the first passage 33*a*. Similarly, on a center of the second passage 33*b*, the partition member 235 has the twisting part 235*c*. Therefore, it is possible to swirl the refrigerant within the second passage 33*b*.

Sixth Embodiment

Figure 16:
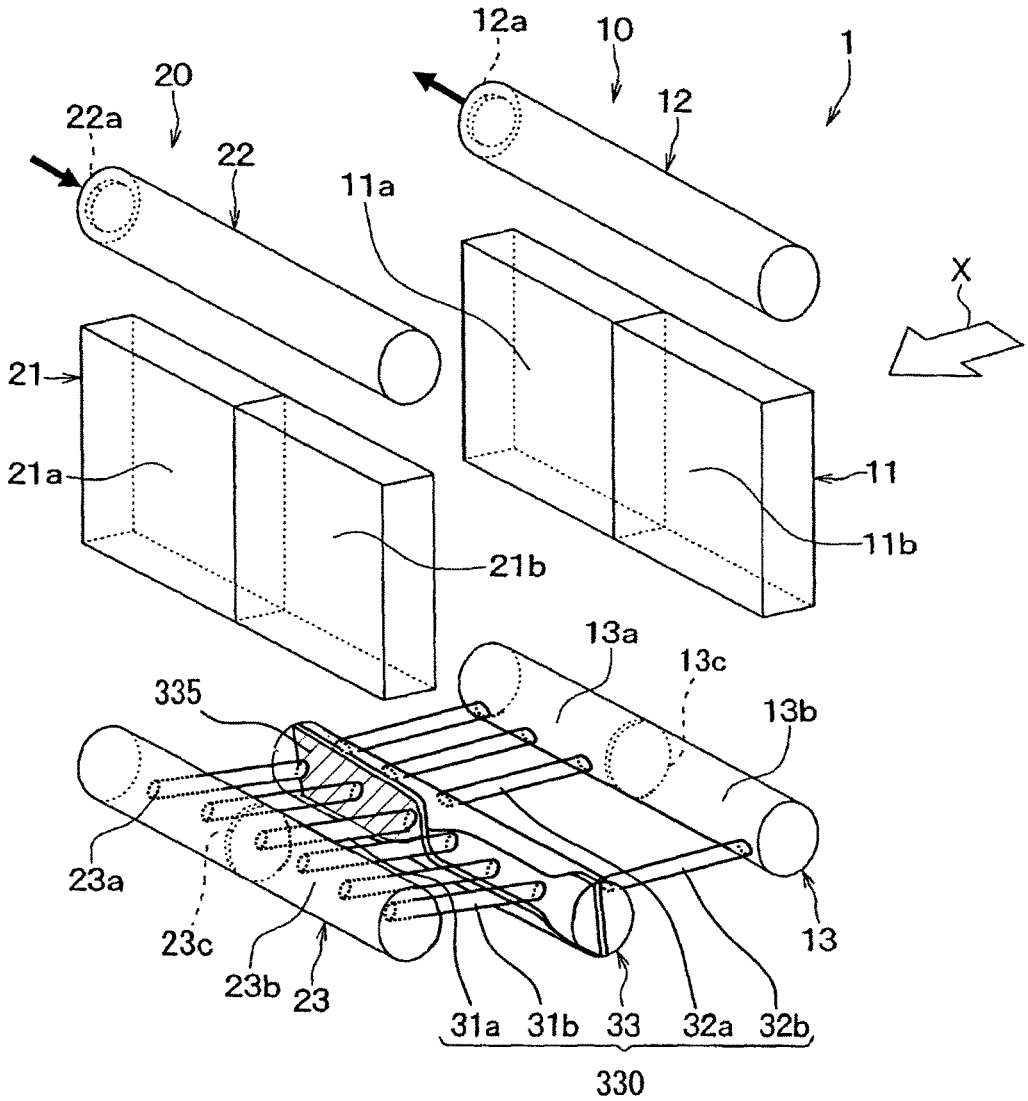
FIG. 16 is a perspective view of a refrigerant evaporator according to a sixth embodiment.

This embodiment is one of modifications based on a basic form provided by the preceding embodiment. The preceding embodiment uses the partition member 35 which has the twisting part 35*c* for 180 degrees. Alternatively, in this embodiment, a partition member 335 illustrated in FIGS. 16, 17, and 18 is used.

The partition member 335 has a twisting part 335*d* for 90 degrees on a center thereof. The partition part 335 also has a twisting part 335*e* for 90 degrees on one end portion thereof. The twisting part 335*e* is located on an end portion of the middle tank part 33. As a result, the first passage 333*a* is positioned to oppose to the second AU core part 11*b*, i.e., the second distribution part 13*b*, only at the end of the middle tank part 33. In other words, the first passage 333*a* and the second distribution part 13*b* are positioned to be able to communicate with each other only at an end portion distanced from the inlet 22*a*.

A communicating passage is disposed between the first collecting part 23*a* and the first passage 333*a*. A communicating passage is disposed between the second collecting part 23*b* and the second passage 333*b*. A communicating passage is disposed between the first distribution part 13*a* and the second passage 333*b*. A communicating passage is disposed between the second distribution part 13*b* and the first passage 333*a*.

Figure 17:
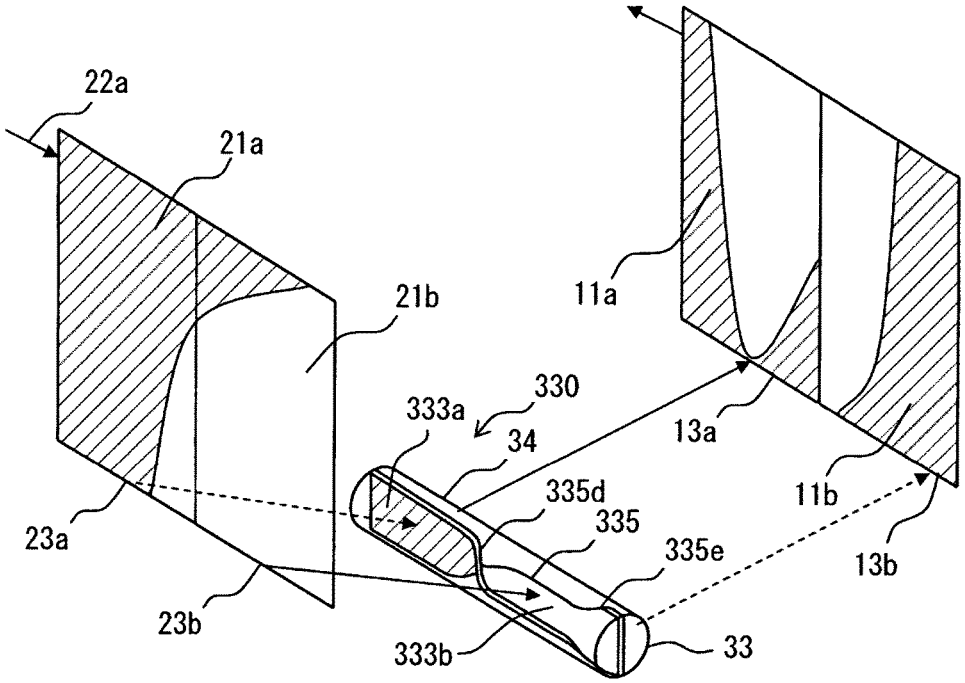
FIG. 17 is a perspective view showing a refrigerant distribution in a low flow amount of the sixth embodiment.
Figure 18:
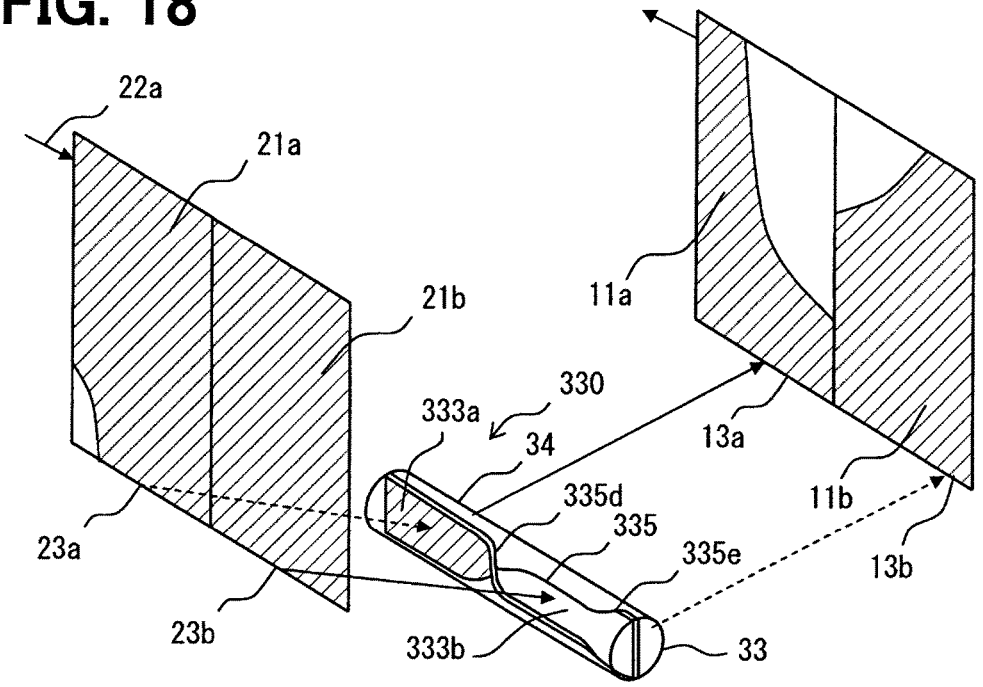
FIG. 18 is a perspective view showing a refrigerant distribution in a high flow amount of the sixth embodiment.

In FIG. 17, hatchings show the liquid component distribution at a small flow amount where a refrigerant flow rate is low. As shown, the liquid component easily flows into the core part 21 at a portion near the inlet 22*a*. Refrigerant via the first AD core part 21*a* is supplied from an end portion of the second distribution part 13*b* through the first passage 333*a*. As a result, in the second AU core part 11*b*, it is possible to flow many liquid components to a portion apart far from the inlet 22*a*. Separation of the refrigerant components of the refrigerant via the twisting parts 335*d* and 335*e* is suppressed. By suppressing separation of the refrigerant components, it is possible to achieve a better refrigerant distribution at the end portion of the second AU core part 11*b*. As a result, it is possible to generate a range where many liquid components exists within the second AU core part 11*b* to overlap with a range, where less liquid component exists, generated within the second AD core part 21*b*.

In FIG. 18, hatchings show a liquid component distribution at a large flow amount where a refrigerant flow rate is high. In a large flow amount, fine refrigerant distribution is obtained in both the AD core part 21 and the AU core part 11. The partition member 335 can provide the above mentioned fine refrigerant distribution, while suppressing pressure loss, since it has the twisting parts 335*d* and 335*e* for 90 degrees.

Seventh Embodiment

Figure 19:
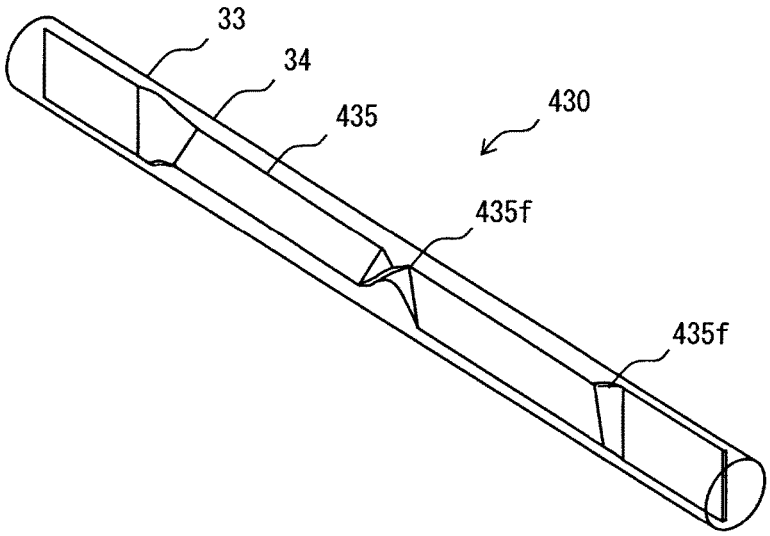
FIG. 19 is a perspective view showing a middle tank of a seventh embodiment.

This embodiment is one of modifications based on a basic form provided by the preceding embodiment. In this embodiment, a partition member 435 shown in FIG. 19 is used.

The partition member 435 has a plurality of twisting parts 435*f*. The plurality of twisting parts 435*f* are arranged along the longitudinal direction of the partition member 435 in a distributed manner. The partition member 435 has the twisting parts 435*f*, which are twisted for a predetermined angle and are disposed on a plurality of different positions in the longitudinal direction. Positions of the twisting parts 435*f* and a twisting angle are set to obtain a predetermined mixing effect of the refrigerant components.

Eighth Embodiment

This embodiment is one of modifications based on a basic form provided by the preceding embodiment. In the above-mentioned embodiments, two passages are defined and formed within the middle tank part 33. Alternatively, in this embodiment, a partition member 535 partitions an inside of the cylindrical member 34 into three or more passages 533*a*, 533*b*, 533*c*, and 533*d*.

Figure 20:
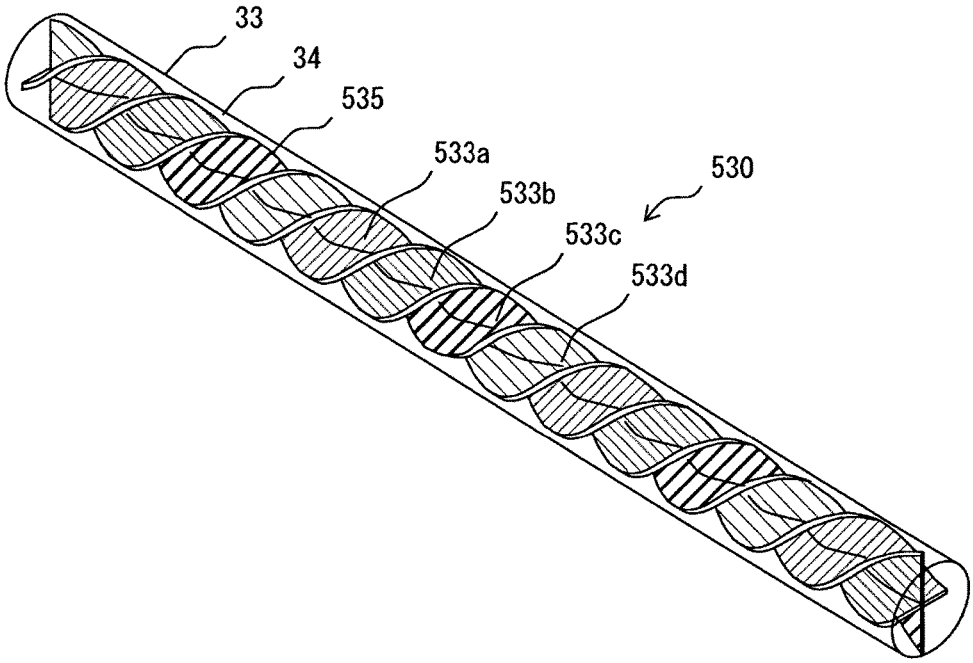
FIG. 20 is a perspective view showing a middle tank of an eighth embodiment.
Figure 21:
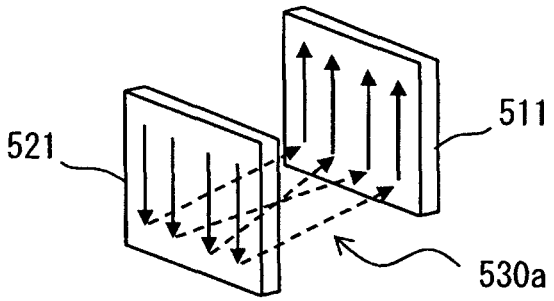
FIG. 21 is a perspective view showing a refrigerant path of the eighth embodiment.
Figure 22:
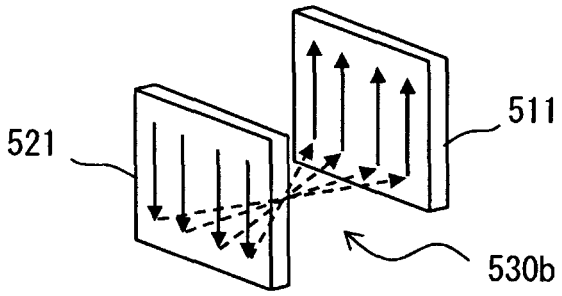
FIG. 22 is a perspective view showing a refrigerant path of the eighth embodiment.
Figure 23:
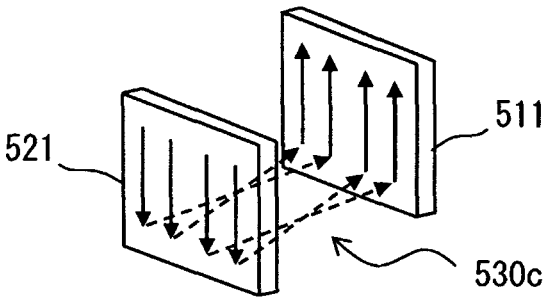
FIG. 23 is a perspective view showing a refrigerant path of the eighth embodiment.
Figure 24:
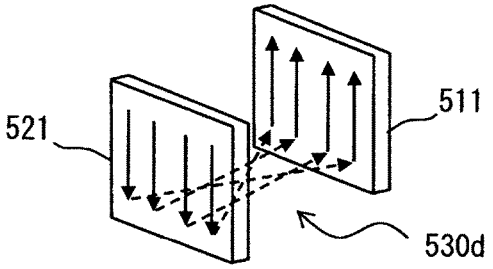
FIG. 24 is a perspective view showing a refrigerant path of the eighth embodiment.

In FIG. 20, the partition member 535 is provided by a plate member with a cross shaped cross section which provides four partitions. The partition member 535 has a plurality of twisting parts. According to this structure, the middle tank part 33 provides 4 passages 533*a*-533*d*.

According to this structure, the core parts 11 and 21 are partitioned into three or more. Specifically, the AD core part 21 is partitioned into four, and the AU core part 11 is partitioned into four.

Such structure makes it possible to flow the refrigerant in different sections in the core parts 11 and 21, i.e., the sections which does not overlap along a flow direction of air. Three or more sections enable a choice of various combinations.

For example, either of the combinations illustrated in FIG. 21, FIG. 22, FIG. 23, and FIG. 24 may be used. In these, the core parts 511 and 521 partitioned into four are used. An interchange part 530*a* provides parallel communications at both ends, and crossing communications at a center. The interchange part 530*b* provides communications which crosses all of the passages to interchange a plurality of sections in a point symmetric manner. The interchange part 530*c* provides crossing communications in parallel which interchange at a half of the core parts 511 and 521, and also at a remaining half. The interchange part 530*d* provides parallel communication at the center, and provides crossing communications at the both ends.

A position of the twisting part, a number of the twisting parts, and a twist angle of the twisting part are set so that the partition member 535 provides the selected communicating relationship. According to such structure, it is possible to provide a desirable refrigerant distribution in the AU core part 11 partitioned into a plurality of sections which are three or more.

Alternative of this embodiment, in order to provide three passages, a partition member with a cross section of Y shape which provides three partitions may be used. Similarly, a partition member which provides many partition by a cross section, such as a cross section providing five partitions, or a cross section providing six partitions, e.g., * shape may be used.

Ninth Embodiment

Figure 25:
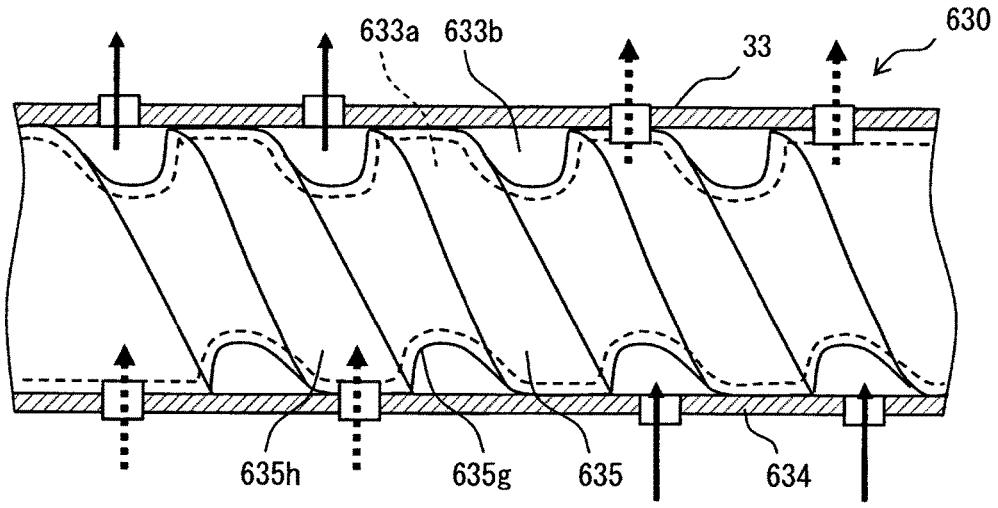
FIG. 25 is a partial cross sectional view showing a middle tank of a ninth embodiment.

This embodiment is one of modifications based on a basic form provided by the preceding embodiment. The preceding embodiments use a plate shaped partition members. Alternatively, as shown in FIG. 25, a tubular shaped partition member may be used.

In this embodiment, the interchange part 30 has the middle tank part 33. The middle tank part 33 has a cylindrical member 634 and a grooved pipe 635 arranged in the cylindrical member 634. The grooved pipe 635 disposed in an inside of the cylindrical member 34 provides a partition member.

The grooved pipe 635 has a single line groove 635*g* which extends spirally on a cylindrical wall surface thereof. A spirally extending ridge 635*h* is formed between the groove 635*g* and the groove 635*g*. The ridge 635*h* is in contact with an inner surface of the cylindrical member. The groove 635*g* is formed by deforming the wall of the grooved pipe 635. Therefore, the groove 635*g* is formed on an outer surface of the grooved pipe 635. A spiral inwardly protruding ridge corresponding to the groove 635*g* is formed on an inner surface of the grooved pipe 635. The groove 635*g* is formed with a predetermined pitch in order to easily form communications to the collecting parts 23*a* and 23*b* and the distributing parts 13*a* and 13*b*.

The grooved pipe 635 provides a first passage 633*a* therein. The grooved pipe 635 provides the second passage 633*b* by the groove 635*g*. For example, the first collecting part 23*a* and the second distribution part 13*b* are communicated by the first passage 633*a*. This communication can be provided with an opening or tubing which penetrates the cylindrical member 634 and the grooved pipe 635. The second collecting part 23*b* and the first distribution part 13*a* may be communicated by the second passage 633*b*. This communication can be provided with an opening or tubing which penetrates only the cylindrical member 634.

The groove 635*g* provides the twisting part in the passage formed between the cylindrical member 34 and the spiral tube 635 by the groove 635*g* itself. Further, the groove 635*g* provides the twisting part in the passage within the spiral tubes 635 by projecting into the spiral tube 635.

According to this structure, the refrigerant flowing through the first passage 633*a* flows while swirling by an inwardly projecting ridge in a spiral manner. Accordingly, separation of the refrigerant components within the first passage 633*a* suppressed. In addition, the refrigerant flowing through the second passage 633*b* flows through the inside of the groove 635*g* which extends spirally, and flows in a swirling manner. Accordingly, separation of refrigerant components in the second passage 633*b* is suppressed.

Alternative to this embodiment, a grooved pipe which has multiple lines, such as three lines or four lines, of grooves may be used.

Other Embodiments

The present invention may be modified in various ways as mentioned below within a range which do not deviate from the meaning of the present invention, and may be without being limited to above-mentioned embodiment.

(1) In the above-mentioned embodiments, examples which have two first refrigerant inlets 14*a* with respect to a single second refrigerant outlet 24*b* are explained. However, the above does not limit, any number may be disposed, as long as there are more first refrigerant inlets 14*a* than the number of the second refrigerant outlets 24*b*.

(2) In the above-mentioned embodiments, examples, which has the second refrigerant inlet 14*b* arranged like the first refrigerant inlet 14*a*, are explained. However, the above does not limit, a single second refrigerant inlet 14*b* may be disposed. Two or more second refrigerant inlets 14*b* and a single first refrigerant inlet 14*a* may be disposed.

(3) In the above mentioned embodiments, the refrigerant evaporator 1 in which, when viewing from the air flow direction, the first AU core part 11*a* and the first AD core part 21*a* are arranged to overlap, and the second AU core part 11*b* and the second AD core part 21*b* are arranged to overlap is explained, however, the above does not limit. As a refrigerant evaporator 1, it may be arranged so that, when viewing from the air flow direction, at least a part of the first AU core part 11*a* and the first AD core part overlap, or at least a part of the second AU core part 11*b* and the second AD core part overlap.

(4) Although it is desirable to arrange the AU evaporating portion 10 on the upstream side in the air flow direction X rather than the AD evaporating portion 20 in the refrigerant evaporator 1, the above does not limit, the AU evaporating portion 10 may be arranged on the downstream side in the air flow direction X rather than the AD evaporating portion 20.

(5) Although, in the above mentioned embodiments, an example in which each core parts 11 and 21 are configured by a plurality of tubes 111 and 211 and fins 112 and 212 are explained, the above does not limit, each core part 11 and 21 may be configured by only the plurality of tubes 111 and 211. In addition, in a case that each core part 11 and 21 is configured by the plurality of tubes 111 and 211 and fins 112 and 212, it is not restricted to the corrugate fin, and a plate fin may be used for the fins 112 and 212.

(6) Although above-mentioned embodiments are explained about an example which applies the refrigerant evaporator 1 to the refrigeration cycle of the vehicle air-conditioner, it may be applied to the refrigeration cycle used for a water heater etc., for example.

In the preceding embodiments, the refrigerant evaporator 1 has two core parts divided into two layers along the flow direction of the fluid to be cooled. Alternatively, between two core parts arranged in two layer arrangement, a part of or all of fins and/or tubes may be arranged over the two layers. Although, a part where two layers cannot be classified clearly may be created partially, it is still possible to find an upstream core part and a downstream core part within the refrigerant evaporator 1. In addition, a cool storage member may be disposed alternative to or in addition to a part of the fins.

In the preceding embodiments, the refrigerant evaporator 1 is provided by a tank and tube type heat exchanger. Alternatively, the refrigerant evaporator 1 may be provided by the drawn cup type heat exchanger.

Although, in the preceding embodiments, the upstream core part and the downstream core part are communicated only through the middle tank part 33, in addition to the above, a communicating passage which does not pass through the middle tank 33, e.g., a communicating passage between the tank 13*b* and the tank 23*b* may be additionally disposed.

In the preceding embodiments, the refrigerant evaporator 1 has the inlet and the outlet on the end of the tank part. Alternatively or additionally, an inlet and/or an outlet may be disposed on a middle part of the tank, e.g., on a center part.

In the preceding embodiments, the partition member 35 and similar ones are disposed over the overall length of the cylindrical member 34, and partition the inside of the cylindrical member 34 into a plurality of chambers over the overall length of the longitudinal direction. Alternatively, the partition member may be disposed only in a part of the longitudinal direction of the cylindrical member 34. A twisting part may be disposed on this partition member too.

The present disclosure is not limited to the above embodiments, and the present disclosure may be practiced in various modified embodiments. The present disclosure is not limited to the above combination, and disclosed technical means can be practiced independently or in various combinations. Each embodiment can have an additional part. The part of each embodiment may be omitted. Part of embodiment may be replaced or combined with the part of the other embodiment. The configurations, functions, and advantages of the above-mentioned embodiment are just examples. The technical scope of the present disclosure is not limited to the descriptions and the drawings. Some extent of the disclosure may be shown by the scope of claim, and also includes the changes, which is equal to and within the same range of the scope of claim.

What is claimed is:

1. A refrigerant evaporator for performing heat exchange between fluid to be cooled flowing through an outside and refrigerant, comprising:

a first evaporating portion and a second evaporating portion arranged in series to a flow direction of the fluid to be cooled, wherein the first evaporating portion and the second evaporating portion each respectively including:

a core part for heat exchange formed by stacking a plurality of tubes in which a refrigerant flows; and a pair of tank parts which are connected with both ends of the plurality of tubes, and perform collecting and distribution of the refrigerant flowing through the plurality of tubes, and wherein the core part in the first evaporating portion has a first core part configured by a group of some tubes among the plurality of tubes of the first evaporating portion core part, and a second core part configured by a group of remaining tubes of the first evaporating portion core part, and wherein the core part in the second evaporating portion has a third core part configured by a group of tubes of the second evaporating portion core part opposing at least a part of the first core part in flow direction of the fluid to be cooled, and a fourth core part configured by a group of remaining tubes of the second evaporating portion core part opposing at least a part of the second core part in a flow direction of the fluid to be cooled, and wherein one tank part among the pair of tank parts in the first evaporating portion is configured to include a first collecting part which collects the refrigerant from the first core part, and a second collecting part which collects the refrigerant from the second core part, and wherein one tank part among the pair of tank parts in the second evaporating portion is configured to include a first distribution part which distributes the refrigerant to the third core part, and a second distribution part which distributes the refrigerant to the fourth core part, and wherein the first evaporating portion and the second evaporating portion are connected through a refrigerant inter change part having a first communicating portion which leads the refrigerant in the first collecting part to the second distribution part and a second communicating portion which leads the refrigerant in the second collecting part to the first distribution part, and wherein the first distribution part is connected with the second communicating portion and is disposed with a refrigerant inlet which makes the refrigerant from the second collecting part flow into the first distribution part, and wherein the second collecting part is connected with the second communicating portion and is disposed with a refrigerant outlet which makes the refrigerant in the second collecting part flow out to the first distribution part, and wherein the refrigerant outlet and the refrigerant inlet are formed in different numbers, and wherein the refrigerant inlet is disposed as a plurality of inlets, and wherein all of the refrigerant inlets are arranged on one side to a center line in a stacking direction of the tubes in the first distribution part, and further comprising:

a flow amount adjustor disposed on the other side to the center line in the first distribution part, which adjusts a refrigerant amount flowing through the inside of the first distribution part.

2. The refrigerant evaporator according to claim 1, wherein the second communicating portion is disposed as a plurality of passages, and each of which is connected to the refrigerant inlets, respectively.

3. The refrigerant evaporator according to claim 1, wherein the number of the refrigerant inlets is more than the number of the refrigerant outlet.

4. The refrigerant evaporator according to claim 3, wherein the number of the refrigerant outlet is one.

5. A refrigerant evaporator for performing heat exchange between fluid to be cooled flowing through an outside and refrigerant, comprising:

a first evaporating portion and a second evaporating portion arranged in series to a flow direction of the fluid to be cooled, wherein the first evaporating portion and the second evaporating portion each respectively including:

a core part for heat exchange formed by stacking a plurality of tubes in which a refrigerant flows; and a pair of tank parts which are connected with both ends of the plurality of tubes, and perform collecting and distribution of the refrigerant flowing through the plurality of tubes, and wherein the core part in the first evaporating portion has a first core part configured by a group of some tubes among the plurality of tubes of the first evaporating portion core part, and a second core part configured by a group of remaining tubes of the first evaporating portion core part, and wherein the core part in the second evaporating portion has a third core part configured by a group of tubes of the second evaporating portion core part opposing at least a part of the first core part in a flow direction of the fluid to be cooled, and a fourth core part configured by a group of remaining tubes of the second evaporating portion core part opposing at least a part of the second core part in a flow direction of the fluid to be cooled, and wherein one tank part among the pair of tank parts in the first evaporating portion is configured to include a first collecting part which collects the refrigerant from the first core part, and a second collecting part which collects the refrigerant from the second core part, and wherein one tank part among the pair of tank parts in the second evaporating portion is configured to include a first distribution part which distributes the refrigerant to the third core part, and a second distribution part which distributes the refrigerant to the fourth core part, and wherein the first evaporating portion and the second evaporating portion are connected through a refrigerant inter change part having a first communicating portion which leads the refrigerant in the first collecting part to the second distribution part and a second communicating portion which leads the refrigerant in the second collecting part to the first distribution part, and wherein the first distribution part is connected with the second communicating portion and is disposed with a plurality of refrigerant inlets which makes the refrigerant from the second collecting part flow into the first distribution part, and wherein all of the refrigerant inlets are arranged on one side to a center line in a stacking direction of the tubes in the first distribution part, and further comprising:

a flow amount adjustor disposed on the other side to the center line in the first distribution part, which adjusts a refrigerant amount flowing through the inside of the first distribution part.

6. The refrigerant evaporator according to claim 5, wherein the second communicating portion is disposed as a plurality of passages, and each of which is connected to the refrigerant inlets, respectively.

7. The refrigerant evaporator according to claim 5, wherein the second collecting part is connected with the second communicating portion and is disposed with a refrigerant outlet which makes the refrigerant in the second collecting part flow out to the first distribution part, and wherein the number of the refrigerant inlets is more than the number of the refrigerant outlet.

8. The refrigerant evaporator according to claim 7, wherein the number of the refrigerant outlet is one.

* * * * *